US006155676A

United States Patent [19]

Etheridge, III et al.

[11] Patent Number: 6,155,676

[45] Date of Patent: Dec. 5, 2000

[54] HIGH-DURABILITY RHODIUM-CONTAINING INK CARTRIDGE PRINTHEAD AND METHOD FOR MAKING THE SAME

[75] Inventors: H. Thomas Etheridge, III; Thomas J. Miller, both of Corvallis, Oreg.

[73] Assignee: Hewlett-Packard Company, Palo Alto, Calif.

[21] Appl. No.: 08/953,111

[22] Filed: Oct. 16, 1997

[51] Int. Cl.[7] ..... B41J 2/05

[52] U.S. Cl. ..... 347/63; 347/44; 347/45; 347/47; 347/65

[58] Field of Search ..... 347/44, 45, 63, 347/47, 65

[56] References Cited

U.S. PATENT DOCUMENTS

| | | | |
|---|---|---|---|
| 3,979,195 | 9/1976 | Strickland | 65/1 |
| 4,329,698 | 5/1982 | Smith | 347/68 |
| 4,497,890 | 2/1985 | Helbert | 430/296 |
| 4,500,895 | 2/1985 | Buck et al. | 347/87 |
| 4,509,062 | 4/1985 | Low et al. | 347/87 |
| 4,749,291 | 6/1988 | Kobayashi et al. | 400/124.1 |
| 4,771,295 | 9/1988 | Baker et al. | 347/87 |
| 4,794,409 | 12/1988 | Cowger et al. | 347/87 |
| 4,794,410 | 12/1988 | Taub et al. | 347/65 |
| 4,929,969 | 5/1990 | Morris | 347/87 |
| 4,937,172 | 6/1990 | Gervay | 430/280.1 |
| 4,944,850 | 7/1990 | Dion | 205/125 |
| 4,963,189 | 10/1990 | Hindagolla | 706/31 |
| 5,017,205 | 5/1991 | Shioura et al. | 65/1 |
| 5,198,023 | 3/1993 | Stoffel | 106/31 |
| 5,198,834 | 3/1993 | Childers et al. | 347/65 |
| 5,208,606 | 5/1993 | Klein et al. | 347/45 |
| 5,278,584 | 1/1994 | Keefe et al. | 347/47 |
| 5,493,320 | 2/1996 | Sandback, Jr. et al. | 347/47 |
| 5,859,654 | 1/1999 | Rodke et al. | 347/47 |

OTHER PUBLICATIONS

*Hewlett–Packard Journal*, vol. 39, No. 4 (Aug. 1988).

Sheppard, N., Vibrational Spectroscopic Studies of the Structure of Species Derived From the Chemisorption of Hydrocarbons on Metal Single–Crystal Surfaces, Ann. Rev. Phys. Chem., 39:589–644 (1988).

Brown, N.F., et al., "Reactions of Unsaturated Oxygenates on Rhodium (111) as Probes of Multiple Coordination of Adsorbates", *J. Am. Chem. Soc.*, 114(11):4258–4265 (1992).

*The Condensed Chemical Dictionary*, 5th Ed., Reinhold Publishing Corporation, New York, p. 945 (1956).

*Primary Examiner*—John Barlow
*Assistant Examiner*—Juanita Stephen

[57] ABSTRACT

A printhead with improved durability characteristics and a method for making the same. A substrate is provided which includes an ink ejector system and a barrier layer. An orifice plate having a bottom surface made of rhodium is affixed to the barrier layer so that the rhodium-containing bottom surface is securely attached to the barrier layer. The use of rhodium in the bottom surface provides substantially improved adhesion characteristics without the use of separate adhesives or, alternatively, various adhesives may be optionally be employed including polyacrylic acid and silane compositions. The rhodium-containing bottom surface also provides improved corrosion resistance. As a result, a unique printhead is produced having improved structural integrity levels. The orifice plate may likewise have a top surface made of rhodium. The use of a rhodium-containing top surface provides enhanced abrasion resistance and avoids corrosion problems.

19 Claims, 4 Drawing Sheets

HIGH-DURABILITY RHODIUM-CONTAINING INK CARTRIDGE PRINTHEAD AND METHOD FOR MAKING THE SAME

BACKGROUND OF THE INVENTION

The present invention generally relates to the production and design of ink cartridge units, and more particularly to an ink cartridge system having a high-durability printhead which includes an orifice plate structure fixedly secured to the printhead in an effective and permanent manner. The printhead is likewise characterized by improved levels of abrasion resistance and corrosion avoidance.

Substantial developments have been made in the field of electronic printing technology. A wide variety of highly-efficient printing systems currently exist which are capable of dispensing ink in a rapid and accurate manner. Thermal inkjet systems are especially important in this regard. Printing units using thermal inkjet technology basically involve a cartridge which includes at least one ink reservoir chamber in fluid communication with a substrate (preferably made of silicon) having a plurality of thin-film heating resistors thereon. Selective activation of the resistors causes thermal excitation of the ink materials retained inside the ink cartridge and expulsion thereof from the cartridge. Representative thermal inkjet systems are discussed in U.S. Pat. Nos. 4,500,895 to Buck et al.; 4,794,409 to Cowger et al.; 4,509,062 to Low et al.; 4,929,969 to Morris; 4,771,295 to Baker et al.; 5,278,584 to Keefe et al.; and the *Hewlett-Packard Journal,* Vol. 39, No. 4 (August 1988), all of which are incorporated herein by reference.

Another important component employed in thermal inkjet printing systems of the type described above (and in other ink cartridge systems using different ink expulsion systems aside from thin-film heating resistors) involves a structure known as an "orifice plate" which is also conventionally characterized as a "nozzle plate". The orifice plate is normally secured to the top portions of the printhead (e.g. above the ink expulsion components). To permit ink ejection from the orifice plate, the plate typically includes a number of openings or "orifices" passing entirely therethrough. Each of these orifices will have a representative diameter of about 0.01–0.05 mm, although this parameter may be varied as needed in accordance with the particular ink cartridge system under consideration. In a thermal inkjet printing system which employs a plurality of heating resistors to eject ink from the cartridge, each one of the openings in the orifice plate is typically in substantial alignment and registry with at least one of the thin film resistors in the printhead so that ink materials which are thermally excited (e.g. heated) during use of the ink cartridge can pass out of the printhead and orifice plate for delivery to a selected print media composition (preferably paper).

Many different materials have been used to produce the orifice plate in an ink cartridge system. For example, in conventional systems, representative and preferred materials suitable for fabricating the orifice plate include a rigid internal support member manufactured from, for example, elemental nickel (Ni), palladium/nickel alloys [Pd/Ni], any other rigid, electroformable metals with engineerable properties, or non-electroformed materials such as steel, rigid plastic, or micromachined metal sheets. This support member made from these materials is thereafter coated on both sides (e.g. top and bottom), along the outer peripheral edges thereof, and within the orifices with a protective metallic outer coating. Representative metallic coating compositions suitable for this purpose typically include elemental platinum (Pt), elemental palladium (Pd), elemental gold (Au), and mixtures thereof, with these metals being designated herein as "noble metals". In the alternative, the orifice plate may be constructed from a single metal composition (compared with the multi-component system listed above) configured in the shape of a flat panel member, with this structure being produced from one or more of the previously-described noble metals (e.g. elemental platinum (Pt), elemental palladium (Pd), elemental gold (Au), and mixtures thereof.)

The orifice plate in an ink cartridge unit provides a number of important functions. For example, the orifice plate is designed to (1) protect the underlying components in the printhead including the ink ejectors [e.g. the thin-film resistors in a thermal inkjet printing system] from abrasion and other physical damage; (2) properly direct the flow of ink from the cartridge to a selected print media material [e.g. paper] in a cohesive, accurate, and controlled manner; and (3) provide a protective outer barrier which is used to control the corrosive effects of ink compositions which, depending on the ink product under consideration, can cause additional damage to the underlying printhead components. However, all of these important goals cannot be effectively achieved unless the orifice plate is fixedly secured to the printhead in a non-detachable manner so that it remains an integral and permanent part of the printhead. Premature disengagement or displacement of the orifice plate from the printhead will prevent the printhead (and cartridge unit) from properly functioning. It will then be necessary to discard the ink cartridge (and attached printhead) which is disadvantageous from an economic and practical standpoint.

Premature orifice plate detachment and/or misalignment typically occurs in accordance with the metallic character thereof (e.g. the use of gold, platinum, palladium, and the like), and the difficulties which may be encountered in adhering this type of orifice plate in position to the underlying printhead components. In a conventional and representative ink cartridge printhead (e.g. of the thermal inkjet variety) which will be discussed in substantial detail below, an underlying "substrate" is provided as previously noted which is typically manufactured from silicon. The operating components of the printhead (e.g. the "ink ejectors" which shall collectively involve the various components used to expel ink from the cartridge unit) are typically positioned directly on the substrate, along with the necessary conductive circuit elements (otherwise known as "traces") associated with the ink ejectors. In a thermal inkjet system, the ink ejectors will comprise a plurality of thin film resistors that are preferably made from a tantalum-aluminum composition known in the art for resistor fabrication. Again, further information concerning the substrate and various components which may be located thereon will be outlined below. Positioned on top of the substrate is an intermediate layer of barrier material (e.g. conventionally known as a "barrier layer") which performs many important functions. The barrier layer covers the conductive traces/circuit elements on the surface of the substrate, but is located between and around the ink ejectors (heating resistors) without covering them. As a result, ink expulsion chambers are formed directly above each ink ejector. In a thermal inkjet system, the ink expulsion chambers are typically characterized as "ink vaporization chambers". Within the individual ink expulsion chambers, ink materials are subjected to the necessary physical processes which enable them to be ejected from the cartridge unit. In a thermal inkjet system, ink materials are heated, vaporized, and subsequently expelled from the ink vaporization chambers through the orifices of the orifice plate.

The barrier layer is traditionally produced from conventional organic compounds [e.g. epoxies, acrylates, and epoxy-acrylate mixtures], photoresist materials, or other similar compositions as outlined in U.S. Pat. Nos. 4,794,410; 4,937,172; 5,198,834; and 5,278,485 which are incorporated herein by reference. Furthermore, the barrier layer is applied to the substrate using conventional processing methods including but not limited to standard photolithographic techniques which are known in the art for this purpose. More specific information regarding representative compositions (e.g. organic compounds) which may be used to produce the barrier layer will likewise be discussed in considerable detail below. In addition to clearly defining the ink expulsion/vaporization chambers in the printhead, the barrier layer performs a number of other important functions including (1) electrical and chemical insulation of the underlying substrate and circuit traces thereon; and (2) enhancement of the overall strength and structural integrity of the entire printhead by imparting an additional degree of rigidity to the structure.

To complete the printhead manufacturing process, the orifice plate is thereafter placed on top of the barrier layer in a manner which allows substantial registry of the openings/orifices through the orifice plate with the underlying ink expulsion/vaporization chambers and ink ejectors (e.g. the thin-film resistors in a thermal inkjet printing system.) To ensure accurate ink delivery and maintain overall cartridge structural integrity, the orifice plate must be fixedly secured to the barrier layer in a non-detachable manner as discussed above. Otherwise, if secure attachment of these components does not take place, a number of problems can occur including (A) misdirected ink expulsion which will typically result in improperly printed images; (B) decreased cartridge life caused by the premature displacement of the orifice plate from the remainder of the printhead; and (C) diminished resistance of the printhead and its internal components to chemical (ink-based) deterioration which can more readily occur when the structural integrity of the printhead is compromised. Again, these problems will often result when the above-listed metals (especially palladium) are used in connection with the orifice plate. Secure adhesion of these materials to the organic compositions which are typically employed to manufacture the barrier layer has traditionally presented a number of difficult problems as previously noted.

A variety of different methods have been implemented in order to secure the orifice plate to the barrier layer. These methods include but are not limited to the use of a separate layer between the orifice plate and barrier layer which contains one or more compositions that are designed to adhere these components together. Representative materials previously used for this purpose involve a number of chemical products including but not limited to uncured polyisoprene photoresist which is applied using standard photolithographic and other known methods as discussed in U.S. Pat. No. 5,278,584 (incorporated by reference). Likewise, the use of photoresist materials for this purpose is discussed in U.S. Pat. No. 5,198,834 which is also incorporated by reference. U.S. Pat. No. 5,198,834 describes the application of a photoresist composition sold under the name "Waycoat SC Resist 900" (Catalog No. 839167) by Olin Hunt Specialty Products, Inc. which is a subsidiary of the Olin Corporation of West Paterson, N.J. (USA). This composition is diluted with a product known as "Waycoat PF Developer" (Catalog No. 840017) and thereafter developed using "Waycoat Negative Resist Developer" (Catalog No. 837773), with both of these materials likewise being sold by Olin Hunt Specialty Products, Inc. as previously noted. Other materials which have been employed as adhesive compounds to attach the orifice plate to the barrier layer include but are not limited to polyacrylic acid, as well as acrylate and epoxy-based adhesives.

Notwithstanding the developments listed above, a need remains for (1) a printhead which avoids premature orifice plate detachment and/or misalignment that is caused by incomplete adhesion of the orifice plate to the underlying material layers (e.g. the organic compound-based barrier layer); and (2) a method which enables secure and permanent affixation of the orifice plate to the underlying barrier layer in a printhead. Furthermore, it is important that the completed printhead be substantially abrasion resistant and capable of avoiding the corrosive effects of ink materials which are typically used in conventional printing systems. Unless these problems are avoided, the resulting printhead will be subject to premature failure and/or progressively diminished print quality. The present invention involves a unique printhead design and production method which are capable of preventing the difficulties described above. Not only do the materials and methods of the invention avoid problems associated with premature orifice plate detachment, but likewise provide superior levels of corrosion/abrasion resistance. As a result, the overall life of the entire ink cartridge is substantially prolonged, along with the maintenance of high print quality levels. All of these benefits and advantages will become readily apparent from the specific description of the invention set forth below which represents a significant advance in the art of ink cartridge technology.

SUMMARY OF THE INVENTION

It is an object of the present invention to provide an ink cartridge printhead of improved design and operating efficiency.

It is another object of the invention to provide an ink cartridge printhead having high-durability characteristics.

It is another object of the invention to provide a high-durability ink cartridge printhead which is characterized by an improved degree of structural integrity.

It is another object of the invention to provide a high-durability ink cartridge printhead which enables a consistent level of print quality to be maintained over the life of the ink cartridge.

It is another object of the invention to provide a high-durability ink cartridge printhead which has a long functional life resulting from an improved level of structural integrity.

It is another object of the invention to provide a high-durability ink cartridge printhead which avoids problems associated with the corrosive effects of ink compositions.

It is another object of the invention to provide a high-durability ink cartridge printhead which is characterized by superior resistance to physical abrasion.

It is another object of the invention to provide a high-durability ink cartridge printhead in which the overall structural integrity of the printhead is improved through the use of a unique orifice plate structure that is produced from a special material that adheres in a superior manner to underlying printhead components. As a result, premature orifice plate detachment/displacement during use of the cartridge is avoided.

It is a further object of the invention to provide a high-durability ink cartridge printhead in which the superior adhesion characteristics of the specialized material used to produce the orifice plate enable attachment of the orifice plate to underlying printhead components (e.g. the barrier layer) in a direct, self-adhesive manner. Using this approach, the orifice plate is secured to the barrier layer without the use of adhesive compositions (or other intervening material layers) therebetween, with the orifice plate being directly attached to the barrier layer.

It is a still further object of the invention to provide a high-durability ink cartridge printhead wherein the special material used to manufacture the orifice plate likewise provides enhanced corrosion/abrasion resistance over the life of the printhead.

It is a still further object of the invention to provide a high-durability ink cartridge printhead which utilizes thermal inkjet technology.

It is an even further object of the invention to provide a unique method for producing the printhead described above which is characterized by all of the foregoing benefits.

The specialized printhead system and production method of the claimed invention will now be summarized. More detailed information along with a discussion of specific construction materials and processing parameters will be provided below in the Detailed Description of Preferred Embodiments section.

As noted above, the present invention involves a high-durability printhead system and production method which provide numerous important benefits. These benefits (which will become readily apparent from the discussion set forth below) include greater overall structural integrity, more secure adhesion of the orifice plate to the other material layers in the printhead, self-adhesion of the orifice plate to the underlying barrier layer without the use of separate adhesives, and improved corrosion/abrasion resistance. The claimed invention effectively enables these and other benefits to be achieved by providing a unique orifice plate structure which is produced from a specially-selected material. Accordingly, the orifice plate and printhead described herein represent a substantial departure from conventional printing systems.

At the outset, it is again important to emphasize that the present invention shall not be restricted to the use of the claimed printhead with any particular type of ink cartridge or ink storage/delivery system. The claimed printhead is prospectively applicable to systems in which the printhead is directly attached to the cartridge of interest or attached using an appropriate fluid transfer conduit assembly to a remotely-positioned ink reservoir chamber. In this regard, the products and processes described below may be used in connection with a wide variety of different ink storage devices.

In accordance with a preferred embodiment of the invention, a unique printhead structure and construction method are disclosed which enable the orifice plate (or "nozzle plate") of the printhead to be securely and permanently attached in position, notwithstanding corrosive and physical forces which may be encountered by the printhead during operation. As a result, printhead longevity is substantially improved compared with prior systems, especially those which involve the use of orifice plates made from gold, platinum, palladium, or other comparable metals that are normally difficult to adhere in position on the printhead. To produce the claimed printhead, a substrate is initially provided which is manufactured of, for example, silicon as outlined in greater detail below. The substrate (which has an upper surface) is designed to retain the operating components of the printhead assembly thereon. Specifically, the upper surface of the substrate comprises at least one and preferably multiple ink ejectors thereon. The term "ink ejector" as used herein shall encompass any component, element, device, or structure which is capable of expelling ink materials on-demand from the printhead. While the present invention shall be described herein with primary reference to thermal inkjet technology, many other technologies may be associated with the ink ejectors of interest. In a thermal inkjet printing system, a plurality of thin-film heating resistors are provided on the upper surface of the substrate, with the resistors typically being of the tantalum-aluminum variety. Each of the thin-film heating resistors functions as an "ink ejector" for controlled ink expulsion from the printhead. Other devices which may be employed in connection with the ink ejectors of the invention include but are not limited to piezoelectric elements and the like. The upper surface of the substrate may likewise include a plurality of logic transistors and metallic circuit traces (conductive pathways/elements) which electrically communicate with the resistors (or other ink ejectors) so that they can be activated in a controlled manner. The circuit traces may be fabricated from one or more elemental noble metals. Of particular interest is the use of gold for this purpose.

Also positioned on at least a portion of the upper surface of the substrate is a layer of barrier material (e.g. a "barrier layer"). Many different compositions may be used to produce the barrier material, with the present invention not being restricted to any particular products for this purpose. Representative compounds suitable for use in manufacturing the layer of barrier material include but are not limited to the following organic compounds: (1) dry photoresist films containing half acrylol esters of bis-phenol; (2) epoxy monomers; (3) acrylic and melamine monomers [e.g. which are sold under the trademark "Vacrel" by E.I. DuPont de Nemours and Company of Wilmington, Del. (USA)]; and (4) epoxy-acrylate monomers [e.g. which are sold under the trademark "Parad" by E.I. DuPont de Nemours and Company of Wilmington, Del. (USA)]. All of these materials have a number of common features including an organic character, as well as the capability to create the fine resolution necessary to produce an efficiently-operating printhead either through standard lithographic processing technologies or other methods (e.g. micromolding and the like). The foregoing materials are also thermally/dimensionally stable, and capable of withstanding chemical attack from ink materials. In thermal inkjet systems (which are of primary interest in this case), the barrier layer is applied between and around the ink ejectors (e.g. resistors) without covering them. As a result, an ink expulsion/vaporization chamber is formed directly above each resistor as discussed in considerable detail below. Within each chamber, ink materials are heated, vaporized, and subsequently expelled from the printhead.

The barrier layer is applied to the upper surface of the substrate using standard photolithographic techniques or other methods known in the art for this purpose. In addition to clearly defining the vaporization chambers, the barrier layer also functions as a chemical and electrical insulating layer relative to the circuit traces, logic transistors, and other comparable elements on the substrate as previously noted. Likewise, the barrier layer imparts added strength and structural integrity to the printhead.

Next, the unique and highly specialized orifice plate member of the claimed invention is provided. The orifice plate member functions as a nozzle structure for the controlled, direction-specific delivery of ink onto a selected print media material (e.g. paper) during expulsion from the printhead. The orifice plate member comprises a bottom surface and at least one or more openings or "orifices" which pass entirely through the plate. In accordance with the present invention, the bottom surface of the orifice plate member is comprised of rhodium [Rh], preferably in elemental form, although rhodium alloys may likewise be used. Regarding the phrase "having a bottom surface comprised of rhodium" as it applies to the orifice plate member, this feature of the invention can be accomplished in many ways. For example, an orifice plate may be provided which consists entirely of rhodium (e.g. in elemental or alloy form) so that, when viewed in cross-section, the plate will have a substantially uniform metallic character. Being constructed of a single rhodium-containing panel, this structure will necessarily have a bottom surface comprised of rhodium. However, in a preferred embodiment, the orifice plate member will consist of an internal plate-like support member made of rigid, strength-imparting material (e.g. nickel [Ni], palladium/nickel alloys [Pd/Ni], or a variety of other compositions as outlined below) which is uniformly coated on all sides (or at least the bottom surface) with a metallic coating layer which contains rhodium. As a result, the bottom surface of the orifice plate member in this embodiment will again be "comprised of rhodium." Accordingly, this phrase shall be construed to encompass many different orifice plate structural designs provided that, in some manner, the bottom surface of the plate is made from rhodium. Likewise, the phrase "comprised of rhodium" in connection with the bottom surface shall also be construed to encompass both elemental rhodium or rhodium-containing alloys as further defined below. Additional information concerning the orifice plate member (including dimensions, thickness values, and other features), as well as the rhodium materials associated therewith will be presented in the Detailed Description of Preferred Embodiments section.

At this point, the orifice plate member is secured in position on top of the layer of barrier material. Regarding orifice plate members comprised of non-rhodium materials [e.g. gold, platinum and/or palladium], prior attachment methods involving the use of conventional barrier compositions/adhesive materials have often resulted in inadequate adhesion of the orifice plate to the barrier layer. This problem adversely affected the overall structural integrity of the entire printhead. The present invention solves the foregoing problem in a highly effective manner through the use of an orifice plate having a bottom surface comprised of rhodium as previously noted. Specifically, the rhodium present in the bottom surface of the orifice plate member more readily adheres to the underlying barrier layer (e.g. comprised of the materials listed above and other organic barrier compounds known in the art) in a self-adhesive manner so that the bottom surface of the orifice plate is directly attached to the barrier layer. The terms "directly attached" and "self-adhesive" as used herein shall be defined to involve a situation in which the rhodium-containing bottom surface of the orifice plate and the barrier layer are secured together through the direct interaction of the rhodium in the orifice plate with the barrier layer without the use of separately-applied adhesives or other intervening material layers positioned therebetween. As a result of this direct attachment process, the printhead structure and the production system associated therewith are greatly simplified, thereby enabling reduced material and labor costs. While the improved adhesion characteristics of rhodium in the orifice plate of the present invention are not entirely understood, it is believed that, from a chemical standpoint, greater adhesion is achieved through the use of rhodium because it is capable of effectively bonding with multiple functional groups on the barrier material as discussed in considerable detail below. However, the claimed product and process shall not be restricted to any particular theories of operation in connection with the benefits listed herein.

In addition, while the self-adhesive character of the rhodium in the bottom surface of the orifice place enables direct attachment of the orifice plate to the barrier layer in a highly unique manner, it is likewise possible to secure these components together using adhesive materials if needed and desired in order to achieve an even greater degree of adhesion in certain cases. This additional adhesion may be desired in special printhead applications (e.g. systems which involve high temperatures, physically adverse operating conditions, and/or the use of highly corrosive ink materials). While the use of adhesive compositions to secure the rhodium-containing orifice plate to the underlying barrier layer is not required in a preferred embodiment, a decision to use separate adhesive compounds to supplement the unique capabilities of rhodium may be determined in accordance with preliminary pilot testing involving the factors listed above. Even if additional adhesives are employed between the rhodium-containing bottom surface of the orifice plate and the barrier layer, the use of rhodium to produce the orifice plate will provide substantially superior adhesion (in cooperation with the selected adhesives) compared with non-rhodium-containing orifice plates when such plates are used with the same adhesive materials. Thus, regardless of whether separate adhesive materials are employed, the presence of rhodium in the bottom surface of the orifice plate in order to produce a rhodium-containing "bonding surface" provides a unique degree of adhesion which constitutes a substantial departure from prior systems.

The next step in the production process involves attaching (e.g. securing) the bottom surface of the orifice plate member and the layer of barrier material together in order to produce the completed high-durability printhead. This is accomplished in accordance with the present invention using two different methods as indicated above. First, in a preferred embodiment, the rhodium-containing bottom surface of the orifice plate (e.g. the rhodium-containing metallic coating layer as noted above) and the layer of barrier material are urged together (along with the application of heat and pressure if needed as outlined further below), thereby resulting in self-adhesion of the orifice plate to the barrier layer and vice versa. Self-adhesion of these components as previously discussed is a key benefit provided by the use of rhodium in the bottom surface of the orifice plate. Once the self-adhesion process takes place, the printhead assembly process is substantially completed.

In a second embodiment, an optional adhesive composition may be applied to at least one of the rhodium-containing bottom surface of the orifice plate member (e.g. the rhodium-based metallic coating layer) and the layer of barrier material on the substrate. Many different adhesive materials may be used for this purpose, with the invention not being restricted to any particular chemical compositions. In this regard, the claimed product and process are prospectively applicable to a number of adhesive products ranging from uncured poly-isoprene photoresist which is applied using standard photolithographic and other known methods as described in U.S. Pat. No. 5,278,584 (incorporated by reference) to standard epoxy and acrylate-based adhesive materials. However, in a representative and preferred embodiment, it has been discovered that optimum results are achieved in connection with the rhodium materials in the bottom surface of the orifice plate if the adhesive composition involves (1) polyacrylic acid; or (2) a selected silane coupling agent. The term "polyacrylic acid" shall be defined to involve a chemical compound having the following basic polymeric structure: $[CH_2CH(COOH)]_n$ wherein n=25–10,000. Likewise, the term "silane coupling agent" as used herein shall be defined to encompass compositions which basically include one or more functional groups combined with silicon to produce an adhesive material. This term shall involve a wide variety of compounds (including silanes and thiosilanes) without restriction to any particular compositions and materials. Representative examples of silane coupling agents which may be employed in the present invention include but are not limited to the following compounds:

1. $RSi(OH)_3$
2. $RSi[O(CH_2)_xCH_3)]_3$ [wherein x=0–20]
3. $RSi(SH)_3$

In all of the structural formulas listed above, the following R groups are applicable:

| | | |
|---|---|---|
| (A) | $(CH_2)_nCH_3$ | [wherein n = 0–20] |
| (B) | $(CH_2)_nNH_2$ | [wherein n = 0–20] |
| (C) | $(CH_2)_nCO_2H$ | [wherein n = 0–20] |
| (D) | $(CH_2)_nCN$ | [wherein n = 0–20] |
| (E) | $(CH_2)_nOH$ | [wherein n = 0–20] |
| (F) | $(CH_2)_nCONH_2$ | [wherein n = 0–20] |
| (G) | $(CH_2)_nO(CH_2)_nCH_3$ | [wherein n = 0–20] |
| (H) | $(CH_2)_nCO(CH_2)_nCH_3$ | [wherein n = 0–20] |
| (I) | $(CH_2)_nCO_2(CH_2)_nCH_3$ | [wherein n = 0–20] |
| (J) | $(CH_2)_nX$ | [wherein n = 0–20 and X = Cl, F, Br, I] |

Further information regarding adhesive materials that are preferred in the present invention and the unique interaction of these materials with rhodium will be set forth below.

Once the selected adhesive material is applied to at least one of the rhodium-containing bottom surface of the orifice plate member and the layer of barrier material, both of these components are urged together (attached) so that the bottom surface of the orifice plate member is secured to the layer of barrier material (and vice versa) using the adhesive composition. As a result, the adhesive composition is positioned between the bottom surface of the orifice plate member and the layer of barrier material after both components are attached together. This step completes the production process, thereby resulting in a printhead which is characterized by a high degree of structural integrity resulting from the strong and secure adhesion of the orifice plate to the barrier layer. Likewise, the bottom surface of the orifice plate is protected from the corrosive effects of ink compositions. Both of these important benefits are achieved through the use of an orifice plate structure wherein the bottom surface thereof is comprised of rhodium (in elemental or alloy form). In addition, when a separate adhesive composition is employed, the rhodium-containing bottom surface of the orifice plate shall nonetheless be considered "directly affixed" to the layer of barrier material in a preferred (non-limiting) embodiment, with this term involving a situation wherein no intervening metal layers or other layers of material (aside from the above-described adhesive layer) are present between these components. However, it is again important to emphasize that the use of an adhesive composition is not typically required in accordance with the organic compound-based barrier layers of the type discussed above. The lack of such a requirement again results from the unique "self-adhesive" characteristics of rhodium when used in the orifice plate to form an exposed "bonding surface".

In a further alternative embodiment of the invention, all of the process steps and components listed above in connection with the previous embodiments are the same except for the design of the orifice plate member. Specifically, the orifice plate member in this further alternative embodiment not only includes a bottom surface which is comprised of rhodium, but also has a top surface comprised of rhodium (preferably in elemental form although rhodium alloys may likewise be employed.) Regarding the phrase "having a top surface comprised of rhodium" as it applies to the orifice plate member, this feature of the invention can be accomplished in many ways. For example, an orifice plate may be provided as previously discussed which consists entirely of rhodium so that, when viewed in cross-section, the plate will have a substantially uniform metallic character. Being constructed of a single rhodium-containing panel member, this structure will necessarily have a top surface comprised of rhodium. However, in a preferred embodiment, the orifice plate member will consist of an internal plate-like support member made of rigid, strength-imparting material (e.g. nickel [Ni], palladium/nickel alloys [Pd/Ni], or a variety of other compositions as outlined below) which is uniformly coated on all sides (e.g. the top and bottom surfaces) with a metallic coating layer comprised of rhodium. As a result, the top surface of the orifice plate member will again be "comprised of rhodium." Accordingly, this phrase shall be construed to encompass many different orifice plate structural designs provided that, in some manner, the top surface of the plate member is made from rhodium. Likewise, the phrase "comprised of rhodium" as it applies to the top surface shall also be construed to encompass both elemental rhodium or rhodium alloys as noted above. Further information concerning the orifice plate member (including dimensions, thickness values, and other features), as well as the rhodium materials associated therewith will be presented below in the Detailed Description of Preferred Embodiments section. The use of a rhodium-containing top surface in connection with the orifice plate provides additional corrosion protection relative to the exposed upper portions of the orifice plate, as well as abrasion resistance and an improved aesthetic (e.g. mirror-like) appearance. Both of these added benefits directly result from the unique physical attributes of rhodium.

The final printhead product produced in accordance with the claimed process will include the following structural components: (1) a substrate having an upper surface with the upper surface including at least one ink ejector thereon as previously discussed (which will involve one or more resistors in a thermal inkjet system); (2) a layer of barrier material positioned on at least a portion of the upper surface of the substrate; and (3) an orifice plate member having at least one opening therethrough and a bottom surface comprised of rhodium (as defined above which may include a rhodium-containing coating layer on an internal support member), with the bottom surface of the orifice plate member being affixed to the barrier material. Affixation of the bottom surface of the orifice plate member to the barrier material is preferably accomplished in a direct manner so that the bottom surface of the orifice plate member is secured to the barrier layer without any intervening material layers therebetween. Alternatively, affixation may be achieved or augmented using a portion (e.g. a layer or supply) of adhesive material secured to both the bottom surface of the orifice plate member and the barrier layer so that the adhesive material is located between the orifice plate member and the layer of barrier material. Again, many different adhesive compositions can be employed for this purpose ranging from uncured poly-isoprene photoresist which is applied using standard photolithographic and other known methods as discussed in U.S. Pat. No. 5,278,584 (incorporated by reference) to standard epoxy and acrylate-based adhesive materials. However, in a representative and preferred embodiment, optimum results are achieved in connection with the rhodium materials in the bottom surface of the orifice plate if the adhesive composition involves (A) polyacrylic acid; or (B) a selected silane coupling agent. The term "silane coupling agent" is defined above along with representative silane coupling agents. Further information regarding adhesive materials that are preferred in the present invention and the unique interaction of these materials with rhodium will be outlined in the Detailed Description of Preferred Embodiments section. In addition, the orifice plate in the completed printhead may likewise include a top surface comprised of rhodium.

As described in further detail below, an ink cartridge may be produced using the claimed printhead by initially providing a housing comprising a compartment therein which is designed to retain a supply of ink. The printhead of the present invention which includes elements (1)–(3) listed above (along with a selected optional adhesive composition between the orifice plate and the barrier layer if desired) is then operatively connected (e.g. directly or remotely attached) to the housing so that the printhead is in fluid communication with the compartment in the housing.

Compared with prior printhead designs, the claimed structure is characterized by a number of benefits. These benefits include but are not limited to: (A) a greater degree of strength, durability, and shock resistance; (B) improved printhead longevity; (C) more uniform print quality and reliability over the life of the printhead; (D) enhanced corrosion resistance; (E) a more aesthetic (mirror-like) visual appearance; and (F) an improved level of overall structural integrity. Accordingly, the present invention represents a significant advance in the art of ink printing technology. These and other objects, features, and advantages of the invention will be discussed below in the following Brief Description of the Drawings and Detailed Description of Preferred Embodiments.

DETAILED DESCRIPTION OF PREFERRED EMBODIMENTS

Figure 1:
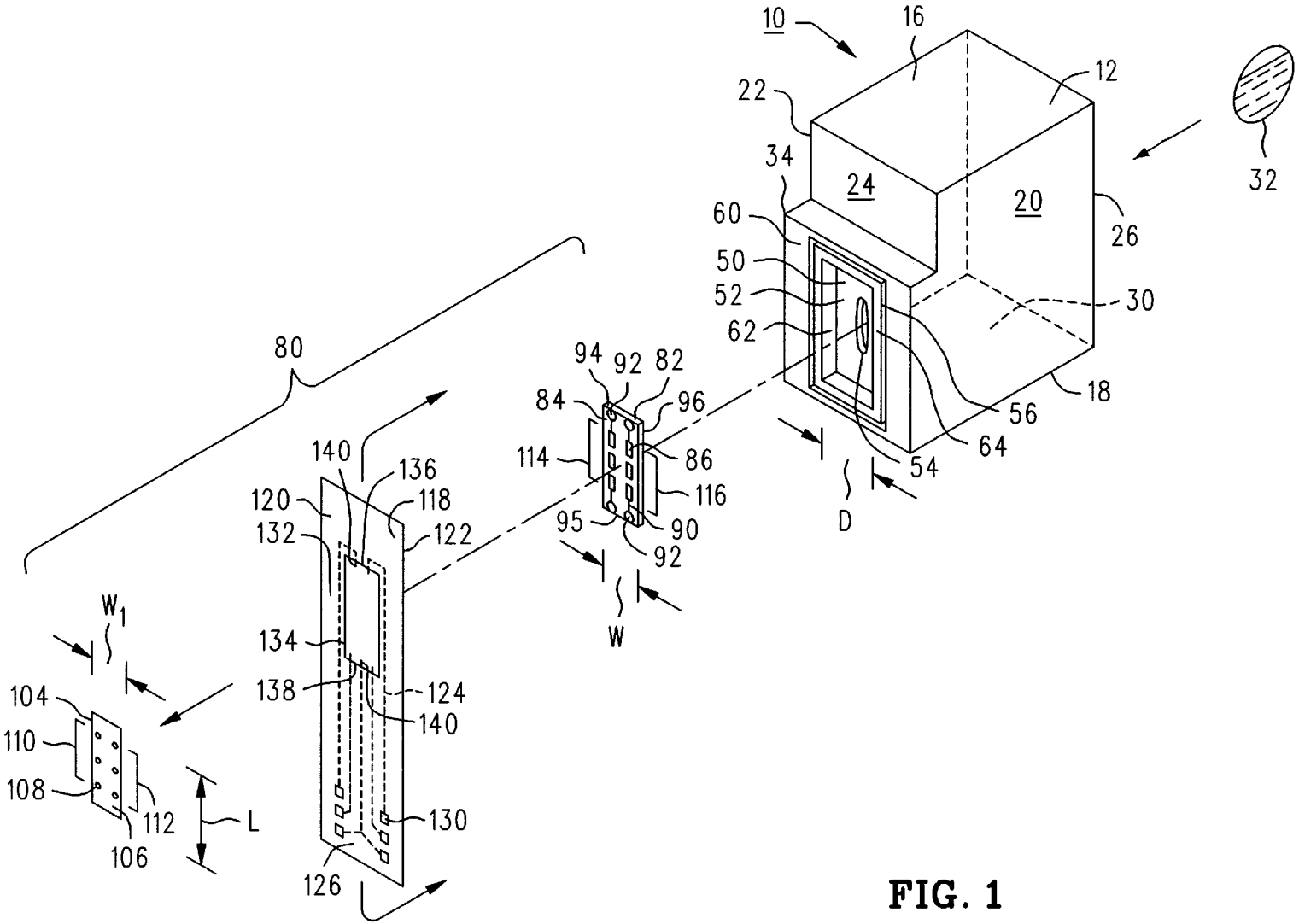
FIG. 1 is a schematically-illustrated exploded perspective view of a representative ink cartridge suitable for use in accordance with the present invention.

As discussed in detail below, the present invention involves a high-durability ink cartridge system in which a specially constructed orifice plate is securely affixed to the underlying printhead components (e.g. the barrier layer) in an effective and permanent manner. Premature displacement and/or detachment of the orifice plate is therefore prevented which results in prolonged cartridge life. Likewise, the resulting printhead is characterized by improved levels of abrasion/scratch resistance and the avoidance of problems caused by the corrosive effects of ink materials. To accomplish these goals, a specialized orifice plate structure is provided which represents a substantial departure from standard orifice plate designs. In this manner, the overall structural integrity, durability, and resistance of the printhead to the corrosive effects of ink compositions are considerably improved compared with conventional printhead systems. The claimed product and process therefore represent an advance in the art of ink cartridge design. While the present invention shall be described below with primary reference to thermal inkjet technology, many different ink cartridge systems may be employed in connection with the specialized components of the invention provided that the selected cartridge includes a housing with an internal compartment, a printhead in fluid communication with the compartment on a direct or remote basis, and at least one ink ejector associated with the printhead. It should also be emphasized that the term "ink ejector" shall again involve any component, device, element, or structure which may be used to expel ink on-demand from the printhead. For example, in a thermal inkjet printing system, "ink ejector" will encompass the use of one or more selectively-energizable thin-film heating resistors as outlined in greater detail below. In this regard, the materials, methods, and structures of the invention are not "cartridge-specific" which will become readily apparent from the detailed discussion presented herein. To provide a clear and complete understanding of the invention, the following description will be divided into three sections, namely, (1) "A. An Overview of Thermal Inkjet Technology"; (2) "B. The Orifice Plate"; and (3) "C. The Completed Printhead".

A. An Overview of Thermal Inkjet Technology

The present invention is again applicable to a wide variety of ink cartridge systems which include (1) a housing having an internal compartment or chamber therein; (2) a printhead attached (e.g. directly or remotely connected) to the housing and in fluid communication with the chamber; and (3) at least one "ink ejector" associated with the printhead. As previously noted, the term "ink ejector" is defined to encompass any component, system, or device which selectively ejects or expels ink on-demand from the printhead. Thermal inkjet cartridges which use multiple heating resistors as ink ejectors are preferred for this purpose. However, the claimed invention shall not be restricted to any particular ink ejectors or inkjet printing technologies as noted above. Instead, a wide variety of different ink delivery devices may be encompassed within the claimed invention including but not limited to piezoelectric drop systems of the general type disclosed in U.S. Pat. No. 4,329,698 to Smith, dot matrix devices of the variety described in U.S. Pat. No. 4,749,291 to Kobayashi et al., as well as other comparable and functionally equivalent systems designed to deliver ink using one or more ink ejectors. The specific operating components associated with these alternative systems (e.g. the piezoelectric elements in the system of U.S. Pat. No. 4,329,698) shall be encompassed within the term "ink ejectors" as previously noted.

To facilitate a complete understanding of the claimed invention as it applies to thermal inkjet technology (which is the preferred system of primary interest), an overview of thermal inkjet technology will now be provided. A representative thermal inkjet cartridge unit is illustrated in FIG. 1 at reference number 10. It shall be understood that cartridge 10 is presented herein for example purposes and is non-limiting. In addition, cartridge 10 is shown in schematic format in FIG. 1, with more detailed information regarding cartridge 10 and its various features being provided in U.S. Pat. No. 4,500,895 to Buck et al.; No. 4,794,409 to Cowger et al.; No. 4,509,062 to Low et al.; No. 4,929,969 to Morris; No. 4,771,295 to Baker et al.; No. 5,278,584 to Keefe et al.; and the *Hewlett-Packard Journal,* Vol. 39, No. 4 (August 1988), all of which are incorporated herein by reference.

With continued reference to FIG. 1, the cartridge 10 first includes a housing 12 which is preferably manufactured from plastic, metal, or a combination of both. The housing 12 further comprises a top wall 16, a bottom wall 18, a first side wall 20, and a second side wall 22. In the embodiment of FIG. 1, the top wall 16 and the bottom wall 18 are substantially parallel to each other. Likewise, the first side wall 20 and the second side wall 22 are also substantially parallel to each other.

The housing 12 further includes a front wall 24. Surrounded by the front wall 24, top wall 16, bottom wall 18, first side wall 20, and second side wall 22 is an interior chamber or compartment 30 within the housing 12 (shown in phantom lines in FIG. 1) which is designed to retain a supply of an ink composition 32 therein (either in liquid [uncontained] form or retained within an absorbent foam-type member [not shown]). The front wall 24 further includes an externally-positioned, outwardly-extending printhead support structure 34 which comprises a substantially rectangular central cavity 50 therein. The central cavity 50 includes a bottom wall 52 shown in FIG. 1 with an ink outlet port 54 therein. The ink outlet port 54 passes entirely through the housing 12 and, as a result, communicates with the compartment 30 inside the housing 12 so that ink materials can flow outwardly from the compartment 30 through the ink outlet port 54.

Also positioned within the central cavity 50 is a rectangular, upwardly-extending mounting frame 56, the function of which will be discussed below. As schematically shown in FIG. 1, the mounting frame 56 is substantially even (flush) with the front face 60 of the printhead support structure 34. The mounting frame 56 specifically includes dual, elongate side walls 62, 64.

With continued reference to FIG. 1, fixedly secured to housing 12 of the ink cartridge 10 (e.g. attached to the outwardly-extending printhead support structure 34) is a printhead generally designated in FIG. 1 at reference number 80. For the purposes of this invention and in accordance with conventional terminology, the printhead 80 actually comprises two main components fixedly secured together (with certain sub-components positioned therebetween). The first main component used to produce the printhead 80 consists of a substrate 82 preferably manufactured from silicon. Secured to the upper surface 84 of the substrate 82 using standard thin film fabrication techniques is a plurality of individually-energizable thin-film resistors 86 which function as "ink ejectors" and are preferably fabricated from a tantalum-aluminum composition known in the art for resistor construction. Only a small number of resistors 86 are shown in the schematic representation of FIG. 1, with the resistors 86 being presented in enlarged format for the sake of clarity. Also provided on the upper surface 84 of the substrate 82 using conventional photolithographic techniques is a plurality of metallic conductive traces 90 (e.g. circuit elements) which electrically communicate with the resistors 86. The conductive traces 90 also communicate with multiple metallic pad-like contact regions 92 positioned at the ends 94, 95 of the substrate 82 on the upper surface 84. The function of all these components which, in combination, are collectively designated herein as a resistor assembly 96 will be discussed further below.

Many different materials and design configurations may be used to construct the resistor assembly 96, with the present invention not being restricted to any particular elements, materials, and components for this purpose. However, in a preferred, representative, and non-limiting embodiment, the resistor assembly 96 will be approximately 0.5 inches long, and will likewise contain 300 resistors 86 thus enabling a resolution of 600 dots per inch ("DPI"). The substrate 82 containing the resistors 86 thereon will preferably have a width "W" (FIG. 1) which is less than the distance "D" between the side walls 62, 64 of the mounting frame 56. As a result, ink flow passageways are formed on both sides of the substrate 82 so that ink flowing from the ink outlet port 54 in the central cavity 50 can ultimately come in contact with the resistors 86 as discussed further below. It should also be noted that the substrate 82 may include a number of other components thereon (not shown) depending on the type of ink cartridge 10 under consideration. For example, the substrate 82 may likewise comprise a plurality of logic transistors for precisely controlling operation of the resistors 86, as well as a "demultiplexer" of conventional configuration as discussed in U.S. Pat. No. 5,278,584. The demultiplexer is used to demultiplex incoming multiplexed signals and thereafter distribute these signals to the various thin film resistors 86. The use of a demultiplexer for this purpose enables a reduction in the complexity and quantity of the circuitry (e.g. contact regions 92 and traces 90) formed on the substrate 82. Other features of the substrate 82 (e.g. the resistor assembly 96) will be presented below.

Securely affixed to the upper surface 84 of the substrate 82 (with a number of intervening material layers therebetween including a barrier layer as outlined below) is the second main component of the printhead 80. Specifically, an orifice plate 104 is provided as shown in FIG. 1 which is used to distribute the selected ink compositions to a designated print media material (e.g. paper). In accordance with the claimed invention, the orifice plate 104 consists of a panel member 106 (shown schematically in FIG. 1) which is manufactured from at least one metal or plastic composition. The specific metals which are suitable for this purpose, as well as additional details involving the dimensions and other parameters associated with the orifice plate 104/panel member 106 will be provided in the next section. In a typical and non-limiting representative embodiment, the orifice plate 104 will have a length "L" of about 5–30 mm and a width "$W_1$" of about 3–15 mm. These values shall be applicable to all of the various embodiments discussed in the next section entitled "B. The Orifice Plate". However, the claimed invention shall not be restricted to any particular orifice plate parameters unless otherwise indicated herein.

The orifice plate 104 further comprises at least one and preferably a plurality of openings or "orifices" therethrough which are designated at reference number 108. These orifices 108 are shown in enlarged format in FIGS. 1–4. Each orifice 108 in a representative embodiment will have a diameter of about 0.01–0.05 mm. In the completed printhead 80, all of the components listed above are assembled so that each of the orifices 108 is aligned with at least one of the resistors 86 (e.g. "ink ejectors") on the substrate 82. As result, energization of a given resistor 86 will cause ink expulsion from the desired orifice 108 through the orifice plate 104. The claimed invention shall not be limited to any particular size, shape, or dimensional characteristics in connection with the orifice plate 104 and shall likewise not be restricted to any number or arrangement of orifices 108. In a representative embodiment as presented in FIG. 1, the orifices 108 are arranged in two rows 110, 112 on the panel member 106 associated with the orifice plate 104. If this arrangement of orifices 108 is employed, the resistors 86 on the resistor assembly 96 (e.g. the substrate 82) will also be arranged in two corresponding rows 114, 116 so that the rows 114, 116 of resistors 86 are in substantial registry with the rows 110, 112 of orifices 108. Further information concerning this type of metallic orifice plate system is provided in, for example, U.S. Pat. No. 4,500,895 to Buck et al. which is incorporated herein by reference. Likewise, the next section will again discuss in detail the various structural features of the orifice plate 104 including those which depart from conventional designs.

It should also be noted for background purposes that, while the primary embodiment of the invention is applicable to orifice plates produced entirely from metal compositions, alternative printing systems have effectively employed orifice plate structures constructed from non-metallic organic polymer compositions, with these structures typically having a representative and non-limiting thickness of about 1.0–2.0 mil. In this context, the term "non-metallic" will encompass a product which does not contain any elemental metals, metal alloys, or metal amalgams. The phrase "organic polymer" shall involve a long-chain carbon-containing structure of repeating chemical subunits. A number of different polymeric compositions may be employed for this purpose. For example, non-metallic orifice plate members may be manufactured from the following compositions: polytetrafluoroethylene (e.g. Teflon®), polyimide, polymethylmethacrylate, polycarbonate, polyester, polyamide, polyethyleneterephthalate, or mixtures thereof. Likewise, a representative commercial organic polymer (e.g. polyimide-based) composition which is suitable for constructing a non-metallic organic polymer-based orifice plate member in a thermal inkjet printing system is a product sold under the trademark "KAPTON" by the DuPont Corporation of Wilmington, Del. (USA). Further data regarding the use of non-metallic organic orifice plate systems is provided in U.S. Pat. No. 5,278,584.

With continued reference to FIG. 1, a film-type flexible circuit member 118 is likewise provided in connection with the cartridge 10 which is designed to "wrap around" the outwardly-extending printhead support structure 34 in the completed ink cartridge 10. Many different materials may be used to produce the circuit member 118, with representative (non-limiting) examples including polytetrafluoroethylene (e.g. Teflon®), polyimide, polymethylmethacrylate, polycarbonate, polyester, polyamide, polyethyleneterephthalate, or mixtures thereof. Likewise, a representative commercial organic polymer (e.g. polyimide-based) composition which is suitable for constructing the flexible circuit member 118 is a product sold under the trademark "KAPTON" by the DuPont Corporation of Wilmington, Del. (USA) as noted above. The flexible circuit member 118 is secured to the printhead support structure 34 by adhesive affixation using conventional adhesive materials (e.g. epoxy resin compositions known in the art for this purpose). The flexible circuit member 118 enables electrical signals to be delivered and transmitted from the printer unit (not shown) to the resistors 86 (or other ink ejectors) on the substrate 82 as discussed below. The film-type flexible circuit member 118 further includes a top surface 120 and a bottom surface 122 (FIG. 1). Formed on the bottom surface 122 of the circuit member 118 and shown in dashed lines in FIG. 1 is a plurality of metallic (e.g. gold-plated copper) circuit traces 124 which are applied to the bottom surface 122 using known metal deposition and photolithographic techniques. Many different circuit trace patterns may be employed on the bottom surface 122 of the flexible circuit member 118, with the specific pattern depending on the particular type of ink cartridge 10 and printing system under consideration. Also provided at position 126 on the top surface 120 of the circuit member 118 is a plurality of metallic (e.g. gold-plated copper) contact pads 130. The contact pads 130 communicate with the underlying circuit traces 124 on the bottom surface 122 of the circuit member 118 via openings or "vias" (not shown) through the circuit member 118. During use of the ink cartridge 10 in a printer unit, the pads 130 come in contact with corresponding printer electrodes in order to transmit electrical control signals from the printer unit to the contact pads 130 and traces 124 on the circuit member 118 for ultimate delivery to the resistor assembly 96. Electrical communication between the resistor assembly 96 and the flexible circuit member 118 will again be outlined below.

Positioned within the middle region 132 of the film-type flexible circuit member 118 is a window 134 which is sized to receive the orifice plate 104 therein. As shown schematically in FIG. 1, the window 134 includes an upper longitudinal edge 136 and a lower longitudinal edge 138. Partially positioned within the window 134 at the upper and lower longitudinal edges 136, 138 are beam-type leads 140 which, in a representative embodiment, are gold-plated copper and constitute the terminal ends (e.g. the ends opposite the contact pads 130) of the circuit traces 124 positioned on the bottom surface 122 of the flexible circuit member 118. The leads 140 are designed for electrical connection by soldering, thermocompression bonding, and the like to the contact regions 92 on the upper surface 84 of the substrate 82 associated with the resistor assembly 96. As a result, electrical communication is established from the contact pads 130 to the resistor assembly 96 via the circuit traces 124 on the flexible circuit member 118. Electrical signals from the printer unit (not shown) can then travel through the conductive traces 90 on the substrate 82 to the resistors 86 so that on-demand heating (energization) of the resistors 86 can occur.

It is important to emphasize that the present invention shall not be limited to the specific printhead 80 illustrated in FIG. 1 and discussed above, with many other printhead designs also being suitable for use in accordance with the claimed invention. The printhead 80 of FIG. 1 is provided for example purposes and shall not limit the invention in any respect. Likewise, it should also be noted that if a non-metallic organic polymer-type orifice plate system is desired, the orifice plate 104 and flexible circuit member 118 can be manufactured as a single unit as discussed in U.S. Pat. No. 5,278,584.

The final step in producing the completed printhead 80 involves attachment of the orifice plate 104 in position on the underlying portions of the printhead 80 so that the orifices 108 are in precise alignment with the resistors 86 on the substrate 82. As previously noted in connection with the representative cartridge 10 shown in FIG. 1, one or more additional layers of material are typically present between the orifice plate 104 and resistor assembly 96 (e.g. substrate 82 with the resistors 86 thereon). These additional layers perform various important functions including electrical insulation, adhesion of the orifice plate 104 to the resistor assembly 96, and the like. These additional layers (which are not shown in FIG. 1) will be discussed below in connection with the unique orifice plate design of the present invention.

B. The Orifice Plate

Figure 2:
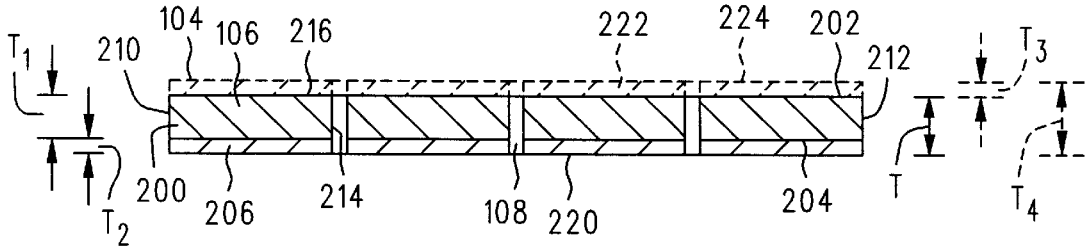
FIG. 2 is a schematically-illustrated cross-sectional view in enlarged format of a representative multi-component orifice plate member which may be used in accordance with the invention, with the view of FIG. 2 passing through one row of orifices.

The orifice plate 104 of the claimed printhead 80 and production process will now be specifically described. As will become readily apparent from the discussion provided below, the orifice plate 104 of the present invention is constructed in a highly unique manner which enables the many benefits of the invention to be achieved. With reference to FIG. 2, a first embodiment of the orifice plate 104 (which structurally consists of the panel member 106) is cross-sectionally illustrated in enlarged format. The orifice plate 104/panel member 106 of FIG. 2 (in a representative and non-limiting example) has an overall thickness "T" of about 20.15–60.6 microns (calculated as discussed below) and is sized to fit over and conform with the substrate 82. Representative length "L" and width "$W_1$" characteristics (FIG. 1) associated with the orifice plate 104 are outlined above in the previous section. However, the present invention shall not be restricted to any particular dimensions in connection with the orifice plate 104, with the invention being prospectively applicable to many different orifice plate units of variable size and shape.

Figure 3:
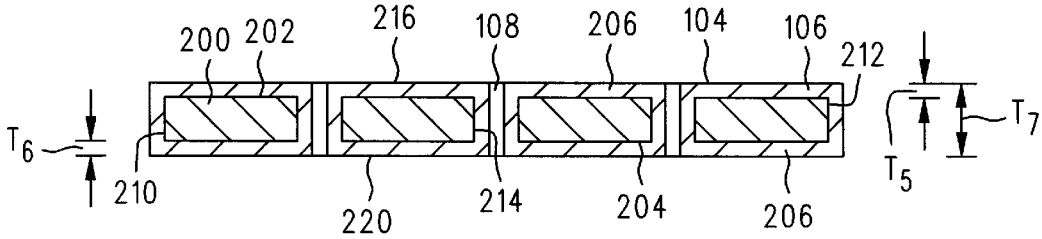
FIG. 3 is a schematically-illustrated cross-sectional view in enlarged format of an alternative embodiment of the multi-component orifice plate member shown in FIG. 2.
Figure 4:
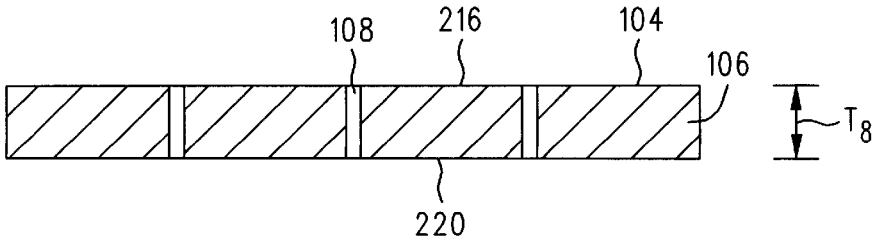
FIG. 4 is a schematically-illustrated cross-sectional view in enlarged format of a representative single-component orifice plate member which may be used in accordance with the invention, with the view of FIG. 4 also passing through one row of orifices.

With continued reference to the embodiment of FIG. 2, the orifice plate 104 shown therein is of composite (e.g. multi-component) construction and is specifically comprised of multiple materials which are fixedly secured together to form an integral unit. The orifice plate 104 in FIG. 2 comprises an internal support member 200 of planar construction that is designed to impart strength and durability to the orifice plate 104. The support member 200 in all of the embodiments set forth herein as shown in FIGS. 2–4 will typically have a thickness "$T_1$" (FIG. 2) of about 20–60 microns. Likewise, as illustrated in FIG. 2, the internal support member 200 further includes an upper face 202 and a lower face 204. Representative and preferred (e.g. non-limiting) materials that may be employed to produce the internal support member 200 include but are not limited to elemental nickel [Ni], palladium/nickel alloys [Pd/Ni] (about 30–95% by weight Pd and about 5–70% by weight Ni), any other rigid, electroformable metals with engineerable properties, or non-electroformed materials such as steel, rigid plastic, or micromachined metal sheets. In this regard, the invention shall not be restricted to any particular construction materials in connection with the internal support member 200, with many different compositions being suitable for this purpose. A metallic coating layer 206 is then provided which is preferably applied to the lower face 204 of the internal support member 200 by conventional means including but not limited to electroplating, electroless deposition, sputter deposition, evaporation, and/or chemical vapor deposition (CVD) techniques which are known in the art for this purpose. In accordance with the claimed invention, the metallic coating layer 206 will be comprised of rhodium [Rh] (optimally elemental rhodium). Rhodium (at. no. 45) is insoluble in acids and fused alkali materials. It has a specific gravity of 12.44, a melting point of 1950–2000° C., and a Brinell hardness rating of 390 (hard) and 135 (annealed). As outlined in greater detail below, the use of rhodium in connection with the orifice plate 104 and printhead 80 provides a number of important benefits including but not limited to: (1) general corrosion [e.g. oxidation] resistance; (2) resistance to chemical interactions (e.g. corrosive/oxidative effects) caused by ink compositions; (3) greatly improved adhesion characteristics relative to the underlying components of the printhead 80; and (4) a high degree of durability, longevity, and structural integrity. In the past, when non-rhodium metal materials were used in connection with the orifice plate 104 (e.g. gold, platinum, palladium, and the like), it had been difficult to effectively secure the orifice plate 104 to the underlying components in the printhead 80 (e.g. the barrier layer). As a result, the orifice plate 104 would often experience incomplete adhesion during the printhead fabrication process or use of the printhead 80. The orifice plate 104 would then be subject to premature detachment and/or displacement, thereby resulting in diminished print quality or printhead failure. The present invention solves this problem in a highly effective manner by using an orifice plate 104 entirely or partially made of a specialized material (e.g. rhodium) which provides the many benefits listed above including greatly improved adhesion characteristics resulting from the formation of a rhodium-based "bonding surface" on the bottom of the orifice plate 104. It should also be noted that the metallic coating layer 206 comprised of rhodium which is positioned on the lower face 204 of the internal support member 200 in the embodiment of FIG. 2 will typically have a uniform thickness "$T_2$" (FIG. 2) of about 0.15–0.60 microns, although this value may be varied in accordance with a variety of factors including the type of printhead 80 being constructed and other considerations as determined by routine preliminary investigation. Likewise, the phrase "comprised of rhodium" shall involve a situation in which the metallic coating layer 206 is produced from (1) elemental rhodium [preferred]; or (2) a rhodium-containing metal alloy. The term "alloy" as used herein shall encompass any type of metallic mixture, amalgam, or other combination which contains at least some rhodium combined with one or more other metals. While the present invention shall not be restricted to any particular metals to be combined with rhodium to produce a given rhodium-containing alloy, representative metals which may be combined with rhodium include but are not limited to platinum [Pt], nickel [Ni], arsenic [As], molybdenum [Mo], and mixtures thereof. Likewise, specific rhodium-containing alloys which are suitable for this purpose include the following exemplary alloy compositions: (A) Rh/Pt [about 3.5–40% by weight Rh and about 60–96.5% by weight Pt]; (B) Rh/Ni [about 30–95% by weight Rh and about 5–70% by weight Ni]; (C) Rh/As [about 30–75% by weight Rh and about 25–70% by weight As]; and (D) Rh/Mo [about 40–70% by weight Rh and about 30–60% by weight Mo]. Regardless of the other metals which are combined with rhodium in a given rhodium-containing alloy, it is preferred that the alloy contain at least about 3–10% by weight or more rhodium. The selection of either elemental rhodium or a rhodium-containing alloy will likewise be undertaken in accordance with routine preliminary pilot testing involving numerous factors including the type of printhead 80 to be constructed, the ink compositions under consideration, and the like.

It is important to emphasize at this point that, in accordance with the present invention as discussed below, it is desired and preferred that, at the very least, the bottom (exposed) surface of the orifice plate 104 be comprised of rhodium. In this manner, the improved adhesion levels outlined herein can be achieved. However, as will become readily apparent from the following discussion, other portions of the orifice plate 104 may likewise be coated with a layer of rhodium (or rhodium-containing compositions) to achieve additional benefits. For example, in the embodiment of FIG. 2 (which represents one of many possible versions of the orifice plate 104), other parts of the orifice plate 104 which may be covered (not shown) with the rhodium-containing metallic coating layer 206 include but are not limited to (1) the side edges 210, 212 of the internal support member 200 (FIG. 2); and (2) the interior wall 214 of each orifice 108. The various characteristics and dimensions of the orifices 108 are discussed above in the previous section, with this information being incorporated by reference in the present section. Likewise, only a small number of orifices 108 are illustrated for example purposes in the above-listed drawing figures, with the claimed invention not being restricted to any particular number of orifices 108 in the orifice plate 104. Application of the rhodium-containing metallic coating layer 206 to the upper face 202 of the internal support member 200 will be discussed below in connection with an overview of the embodiment associated with FIG. 3.

With continued reference to FIG. 2, the completed orifice plate 104 will have a top surface 216 and a bottom surface 220. In accordance with the present invention (and the use of a rhodium-containing metallic coating layer 206 applied to the lower face 204 of the internal support member 200), the bottom surface 220 of the orifice plate 104 shall be considered to be comprised of rhodium. This situation exists since the coating layer 206 is the outermost layer of exposed material on the bottom surface 220 of the orifice plate 104 as clearly illustrated in FIG. 2.

It should also be noted that, in the embodiment of FIG. 2, the top surface 216 of the orifice plate 104 (which basically involves the exposed upper face 202 of the internal support member 200) may remain uncoated with any additional materials if the composition used to produce the internal support member 200 is sufficiently durable as determined by preliminary testing or may instead be covered with a supplemental layer 222 (shown in dashed lines in FIG. 2) of an additional non-rhodium metal composition optimally selected from the group consisting of elemental gold [Au], elemental platinum [Pt], elemental palladium [Pd], or mixtures thereof. If used, the supplemental layer 222 of metal will have a representative and non-limiting thickness value $T_3$ of about 0.15–2.0 microns which will result in a total (increased) orifice plate 104 thickness value $T_4$ (FIG. 2) of about 20.3–62.6 microns. Likewise, if the supplemental layer 222 of metal is employed, the orifice plate will have a top surface 224 (shown in phantom lines in FIG. 2) which shall be comprised of the selected metal(s) associated with the supplemental layer 222.

While not specifically shown in FIG. 2, the supplemental layer 222 of metal may likewise be applied to the side edges 210, 212 of the internal support member 200 and the interior wall 214 of each orifice 108 if needed and desired. However, the present invention shall again not be restricted to any particular thickness parameters or materials applied to the upper face 202 of the internal support member 200, provided that the lower face 204 of the support member 200 is coated at least partially with the rhodium-containing metallic coating layer 206. Again, as outlined in detail below, the use of an orifice plate 104 having a bottom surface 220 which is comprised of rhodium provides many beneficial attributes including but not limited to improved adhesion to underlying printhead components (with or without the use of separate adhesives), as well as a greater degree of strength, structural integrity, and resistance to the corrosive effects of ink materials. The optional use of rhodium in connection with the top surface 224 of the orifice plate 104 will be discussed below relative to the embodiment of FIG. 3.

A further embodiment of the orifice plate 104 is illustrated cross-sectionally in FIG. 3. Reference numbers which appear in FIGS. 2–3 (as well as the other figures in this case) represent components which are common to the embodiments under consideration. The embodiment of FIG. 2 is substantially identical to the embodiment of FIG. 3 with one major exception. Specifically, the rhodium-containing metallic coating layer 206 in the embodiment of FIG. 3 not only covers the lower face 204 of the internal support member 200, but likewise covers the upper face 202 of the support member 200 and preferably all of the other remaining exposed surfaces associated with the support member 200 including (1) the side edges 210, 212; and (2) the interior wall 214 of each orifice 108. The various characteristics and dimensions of the orifices 108 are discussed above in the previous section, with this information being incorporated by reference in the present section. However, it should be noted that the openings through the support member 200 which are used to form the orifices 108 in the embodiment of FIG. 3 may, in fact, be larger by 50% or more compared with the corresponding openings in the internal support member 200 of FIG. 2. This design accommodates the metallic coating layer 206 which is applied to and within the orifices 108 as shown in FIG. 3. Likewise, only a small number of orifices 108 are illustrated for example purposes in FIG. 3, with the present invention not being restricted to any particular number of orifices 108 in the orifice plate 104. The thickness levels of the metallic coating layer 206 (e.g. which is comprised of rhodium as previously discussed) are preferably uniform at all points on the internal support member 200. In this regard, the thickness value $T_5$ associated with the metallic coating layer 206 on the upper face 202 of the internal support member 200 (FIG. 3) will be substantially the same as the thickness value $T_6$ (FIG. 3) of the metallic coating layer 206 on the lower face 204 of the internal support member 200. Specifically, in a preferred and non-limiting embodiment, $T_5$=$T_6$=about 0.15–2.0 microns. The overall thickness $T_7$ of the orifice plate 104 in the embodiment of FIG. 3 will optimally be about 20.3–64 microns. However, the claimed invention shall again not be restricted to any particular dimensions or numerical parameters unless otherwise noted herein. Furthermore, the phrase "comprised of rhodium" as used in this embodiment shall be defined in the same manner listed above in connection with the embodiment of FIG. 2 wherein elemental rhodium (preferred) or a rhodium alloy may be employed. The representative rhodium alloys which were previously described relative to the embodiment of FIG. 2 are equally applicable to the embodiment of FIG. 3.

Application of the rhodium-containing metallic coating layer 206 to both the upper face 202 and lower face 204 of the internal support member 200 (as well as other exposed portions of the support member 200) may again be accomplished by conventional means including but not limited to electroplating, electroless deposition, sputter deposition, evaporation, and/or chemical vapor deposition (CVD) techniques which are known in the art for this purpose.

With continued reference to FIG. 3, the completed orifice plate 104 will again have a top surface 216 and a bottom surface 220. In accordance with the present invention (and the use of a rhodium-containing metallic coating layer 206 applied to the lower face 204 of the internal support member 200), the bottom surface 220 of the orifice plate 104 of FIG. 3 shall be considered to be "comprised of rhodium." This situation exists since the metallic coating layer 206 is the outermost layer of exposed material on the bottom surface 220 of the orifice plate 104. Likewise, because the rhodium-containing metallic coating layer 206 is also applied to the upper face 202 of the internal support member 200 as shown in FIG. 3, the top surface 216 of the orifice plate 104 shall also be considered to be "comprised of rhodium." This situation exists since the metallic coating layer 206 is the outermost layer of exposed material on the top surface 216 of the orifice plate 104.

The benefits provided by the embodiment of FIG. 3 (which is more completely covered with rhodium compared with the embodiment of FIG. 2) are substantially the same as those listed above in connection with the embodiment of FIG. 2. These benefits (which primarily result from placement of the rhodium-containing metallic coating layer 206 on the lower face 204 of the internal support member 200) include improved self-adhesion to underlying printhead components compared with non-rhodium orifice plate systems produced from gold, platinum, palladium, and the like, a greater degree of overall structural integrity/durability, and improved corrosion (oxidation) resistance within the interior regions of the printhead 80. However, placement of the rhodium-containing metallic coating layer 206 on the upper face 202 of the internal support member 200 also provides the added benefits of: (1) greater abrasion/scratch resistance; (2) improved corrosion (oxidation) resistance relative to the exterior regions of the printhead 80; and (3) a more aesthetic, mirror-like outward visual appearance. These supplemental benefits will be outlined in further detail below.

In a final alternative embodiment (FIG. 4), the orifice plate 104 may have a single-component structure compared with the composite (e.g. multi-component) character of the orifice plate designs presented in FIGS. 2 and 3. Instead of having an internal support member 200 surrounded by an outer metallic coating layer 206, the orifice plate 104 as shown in FIG. 4 may instead simply consist of a single, solid panel member 106 (e.g. having orifices 108 therethrough) which is constructed entirely from rhodium (e.g. elemental rhodium [preferred] or a rhodium alloy as previously discussed in connection with the embodiments of FIGS. 2 and 3, with the definition of "rhodium alloy" provided above being incorporated by reference relative to the embodiment of FIG. 4). The representative rhodium alloys which were previously described with respect to the embodiment of FIG. 2 are equally applicable to the embodiment of FIG. 4. While the composite structures of FIGS. 2 and 3 are preferred for strength, durability, and material-cost reasons, the single layer embodiment of FIG. 4 may also be employed wherein the single layer (solid panel member 106) is again constructed of rhodium (in elemental or alloy form). In a preferred and non-limiting representative embodiment, the orifice plate 104 of FIG. 4 will have an optimum thickness value "$T_8$" of about 20–60 microns. However, this value (along with the other numerical parameters listed above) may be varied as needed in accordance with preliminary pilot studies on the printing systems under consideration.

Likewise, because of the single-component construction associated with the orifice plate 104 shown in the embodiment of FIG. 4, the top and bottom surfaces 216, 220 thereof will necessarily be comprised of rhodium as previously defined, thereby providing all of the benefits listed above in connection with the embodiments of FIGS. 2 and 3. These benefits again include (1) general corrosion [e.g. oxidation] resistance; (2) resistance to chemical interactions (e.g. corrosive effects) caused by ink compositions; (3) greatly improved adhesion characteristics relative to the underlying components of the printhead 80; and (4) a high degree of durability, longevity, and structural integrity. Of primary importance is the improved adhesion capacity provided by the use of a rhodium-containing bottom surface 220, with the unique adhesive capabilities of rhodium being discussed in considerable detail below. The completed orifice plate 104 of FIG. 4 also has a pleasing, mirror-like visual appearance which directly results from the rhodium-containing top surface 216.

In summary, all of the embodiments listed above will function effectively in the present invention to provide superior results compared with orifice plates produced from non-rhodium metals (e.g. gold, platinum, palladium, and the like). As previously noted, all statements herein which indicate that the orifice plate 104 has "a bottom surface comprised of rhodium" shall encompass a structure which includes (1) a rhodium-containing coating (e.g. metallic coating layer 206 ) on the lower face 204 of the internal support member 200 (FIGS. 2–3); (2) a panel member 106 which is constructed entirely of rhodium in elemental or alloy form (FIG. 4) so that the bottom surface 220 thereof will necessarily be comprised of rhodium; or (3) any other structure wherein the bottom surface 220 of the orifice plate 104 contains rhodium in some manner.

Likewise, all statements herein which indicate that the orifice plate 104 has "a top surface comprised of rhodium" shall encompass a structure which includes (1) a rhodium-containing coating (e.g. metallic coating layer 206) on the upper face 202 of the internal support member 200 (FIGS. 2–3); (2) a panel member 106 which is constructed entirely of rhodium in elemental or alloy form (FIG. 4) so that the top surface 216 thereof will necessarily be comprised of rhodium; or (3) any other structure wherein the top surface 216 of the orifice plate 104 contains rhodium in some manner. As a final explanatory note, common reference numbers are again used in connection with the orifice plates 104 in FIGS. 2–4 to indicate that all of the listed plate types are substantially equivalent in function and purpose, with the primary difference involving the use of an internal support member 200 in the embodiments of FIGS. 2–3. Having discussed representative orifice plate structures which may be employed in accordance with the invention, attachment of the selected orifice plate 104 to the underlying components of the printhead 80 will now be outlined in substantial detail, along with a specific discussion of the improved adhesion characteristics and greater overall structural integrity resulting from the use of rhodium in the orifice plate 104. Further information will also be provided regarding the particular material layers which are positioned between the orifice plate 104 and the substrate 82 having the ink ejectors (e.g. resistors 86) thereon. While the following discussion shall be undertaken in connection with the orifice plate 104 illustrated in FIG. 3, it is equally applicable in all respects to other orifice plate designs including the designs of FIGS. 2 and 4.

C. The Completed Printhead

Detailed information concerning the completed printhead and the manner in which it is assembled using the orifice plate 104 will now be presented. As illustrated schematically in FIG. 5, the upper surface 84 of the substrate 82 associated with the printhead 80 further comprises an intermediate barrier layer 230 thereon (e.g. a "layer of barrier material") which covers the elongate conductive circuit traces 90 (FIG. 1), but is positioned between and around the ink ejectors (e.g. resistors 86) without covering them. The resistors 86 are illustrated in enlarged format in FIG. 5, with the circuit traces 90 being omitted from FIG. 5 for the sake of clarity. As a result, an ink expulsion/vaporization chamber 232 (FIG. 5) is formed directly above each resistor 86 (or other ink ejector). Again, while the present invention shall be discussed herein with primary reference to thermal inkjet technology, other systems are likewise applicable which incorporate different ink ejectors (e.g. those aside from thin-film heating resistors 86). Within each chamber 232 in a thermal inkjet system, the selected ink materials are heated, vaporized, and subsequently expelled through the orifices 108 in the orifice plate 104.

The barrier layer 230 (which is traditionally produced from conventional organic compounds, namely, photoresist material or similar compositions as outlined in U.S. Pat. No. 5,278,584 and discussed above) is applied to the substrate 82 using standard photolithographic techniques or other methods known in the art for this purpose including but not limited to standard lamination, spin coating, roll coating, extrusion coating, curtain coating, and micromolding processes. In addition to clearly defining the ink expulsion/vaporization chambers 232, the barrier layer 230 also functions as a chemical and electrical insulating layer relative to the various components on the upper surface 84 of the substrate 82 (e.g. the conductive traces 90 [FIG. 1] as well as any transistors [not shown] and the like). Regarding the specific materials which may be employed in connection with the barrier layer 230 (which is optimally produced from one or more organic compositions as previously noted), representative compounds suitable for fabricating the barrier layer 230 include but are not limited to: (1) dry photoresist films containing half acrylol esters of bis-phenol; (2) epoxy monomers, (3) acrylic and melamine monomers [e.g. which are sold under the trademark "Vacrel" by E.I. DuPont de Nemours and Company of Wilmington, Del. (USA)]; and (4) epoxy-acrylate monomers [e.g. which are sold under the trademark "Parad" by E.I. DuPont de Nemours and Company of Wilmington, Del. (USA)]. However, unless otherwise indicated herein, the claimed invention shall not be restricted to any particular compounds in connection with the barrier layer 230 although materials which are generally classified as photoresists or solder-masks are preferred for this purpose. Likewise, in a non-limiting and representative embodiment, the barrier layer 230 will have a thickness "$T_9$" (FIG. 5) of about 5–30 microns although this value may be varied as needed in accordance with preliminary tests on the printhead 80 being constructed.

After deposition of the barrier layer 230 on the upper surface 84 of the substrate 82, the orifice plate 104 having the features and characteristics discussed above is attached in position on the upper face 234 of the barrier layer 230 so that the rhodium-containing bottom surface 220 of the orifice plate 104 may be secured thereto in a highly effective manner. In a preferred embodiment which is accomplished in accordance with the unique characteristics of rhodium, the rhodium-containing bottom surface 220 of the orifice plate 104 is directly attached (e.g. secured/affixed) to the upper face 234 of the barrier layer 230 in a self-adhesive manner. The terms "directly attached" and "self-adhesive" as used herein shall be defined to involve a situation in which the rhodium-containing bottom surface 220 of the orifice plate 104 and the barrier layer 230 are secured together through the direct interaction of the rhodium in the orifice plate 104 with the barrier layer 230 without the use of separately-applied adhesives or other intervening material layers positioned therebetween. As a result of this direct attachment process, the printhead structure and the production system associated therewith are greatly simplified, thereby resulting in reduced material and labor costs.

This direct attachment system may be employed effectively in connection with the organic-based barrier layer compositions discussed above, as well as other organic-type barrier layer compounds which are known in the art for this purpose. Even though the precise chemistry associated with the bonding interactions of these materials (especially rhodium) to produce "self-adhesion" is not entirely understood, it is theorized that the use of rhodium in the bottom surface 220 of the orifice plate 104 produces exceptionally strong adhesion based on the ability of rhodium to effectively bond with multiple functional groups (e.g. those which contain carbon and/or oxygen) on the materials used to manufacture the barrier layer 230. Bonding interactions between rhodium and carbon/oxygen compounds in general are believed to involve a number of complex theories ranging from the formation of oxametallacycle intermediates as stated in Brown, N., et al., "Reactions of Unsaturated Oxygenates on Rhodium (111) as Probes of Multiple Coordination of Adsorbates, *J. Am. Chem. Soc.,* 114 (11) :4258–4265 (1992) to pi-bonding of the rhodium to organic compound(s) as outlined in Sheppard, N., "Vibrational Spectroscopic Studies of the Structure of Species Derived from the Chemisorption of Hydrocarbons on Metal Single-Crystal Surfaces", *Ann. Rev. Phys. Chem.,* 39:589–644 (1988), with both of these articles being incorporated herein by reference. Regardless of which operational theory is selected, the level of adhesion that is achieved using a rhodium-containing orifice plate 104 is superior compared with the conventional metals which are normally employed to construct orifice plates including gold, platinum, palladium, and the like. Likewise, this adhesion is of the "self-adhesive" variety which is particularly beneficial as noted above. However, the claimed processes shall not be restricted to any particular mechanism(s) associated with the direct interaction between the rhodium in the bottom surface 220 of the orifice plate 104 and the compositions used to produce the barrier layer 230 which may involve many different chemical and physical concepts. Regardless of the particular mechanism which enables improved adhesion to take place, the use of rhodium (alone or combined with other metals) in the bottom surface 220 of the orifice plate 104 represents an advance in the art of printhead design which provides the many important benefits recited above.

The final step in the printhead assembly process involves directly attaching the orifice plate 104 to the barrier layer 230 so that the bottom surface 220 of the orifice plate 104 is positioned against the upper face 234 of the barrier layer 230, preferably without any intervening material layers therebetween. This is accomplished in the embodiment of FIG. 5 by placing the bottom surface 220 of the orifice plate 104 against and in direct physical contact with the upper face 234 of the barrier layer 230. Specifically, the bottom surface 220 of the orifice plate 104 is urged toward and against the upper face 234 of the barrier layer 230 which will self-adhere the barrier layer 230 to the orifice plate 104 and vice versa. The claimed process and product as discussed herein shall not be restricted to any particular assembly order in which the orifice plate 104 is attached to the barrier layer 230. The attachment process may take place as outlined above or instead may involve placement of the barrier layer 230 against the orifice plate 104 if desired in accordance with the production equipment and processing facilities under consideration. In this regard, any assembly method(s) may be employed provided that, in some manner, the orifice plate 104 and barrier layer 230 are attached together as discussed above. It should also be noted that the bottom surface 220 of the orifice plate 104 and/or the upper face 234 of the barrier layer 230 are preferably cleaned in a thorough, complete, and conventional manner prior to assembly.

In accordance with this assembly procedure and the use of a rhodium-containing bottom surface 220 associated with the orifice plate 104, both of these components are secured together in a highly effective manner which avoids premature orifice plate 104 detachment/disengagement, eliminates the need to employ separate adhesive compositions under most circumstances, and controls problems associated with internal corrosion (oxidation) caused by chemical interactions between the orifice plate 104 and ink compositions 32 being delivered by the printhead 80. While the foregoing process shall not be limited to any particular temperature and pressure conditions, it is preferred that during physical engagement between the orifice plate 104 and the barrier layer 230, both of these components be subjected (e.g. heated) to a temperature of about 160–350° C., with pressure levels of about 75–250 psi being exerted on such components. A conventional heated pressure-exerting platen apparatus may be employed for this purpose. The exact temperature and pressure levels to be selected in a given situation may be determined in accordance with routine preliminary testing taking into consideration the particular materials being used in connection with the barrier layer 230.

Figure 5:
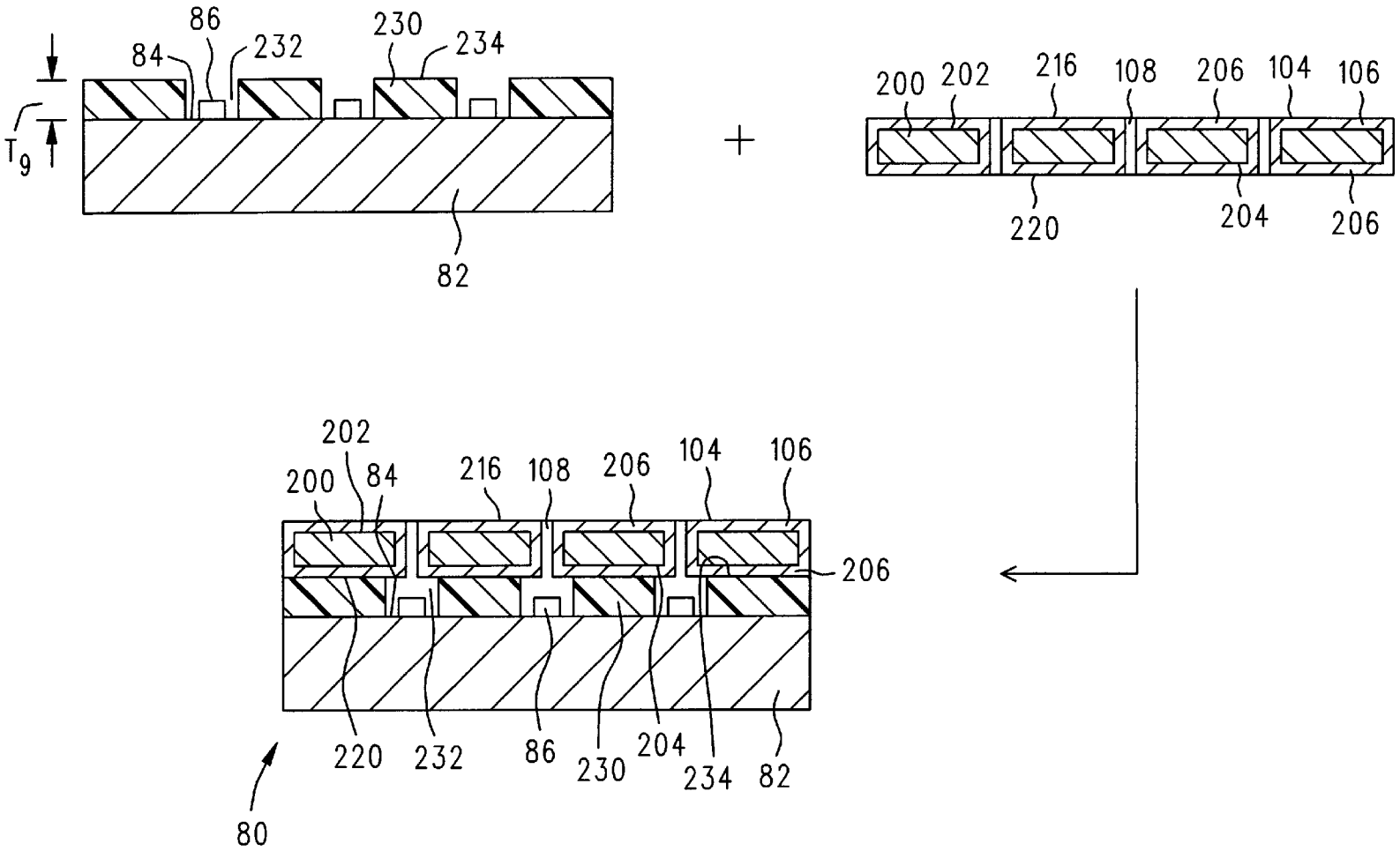
FIG. 5 is a schematic cross-sectional (e.g. partial) view in enlarged format of the completed printhead of the present invention which incorporates the orifice plate of FIG. 3, along with the production steps that are used to produce the printhead.
Figure 6:
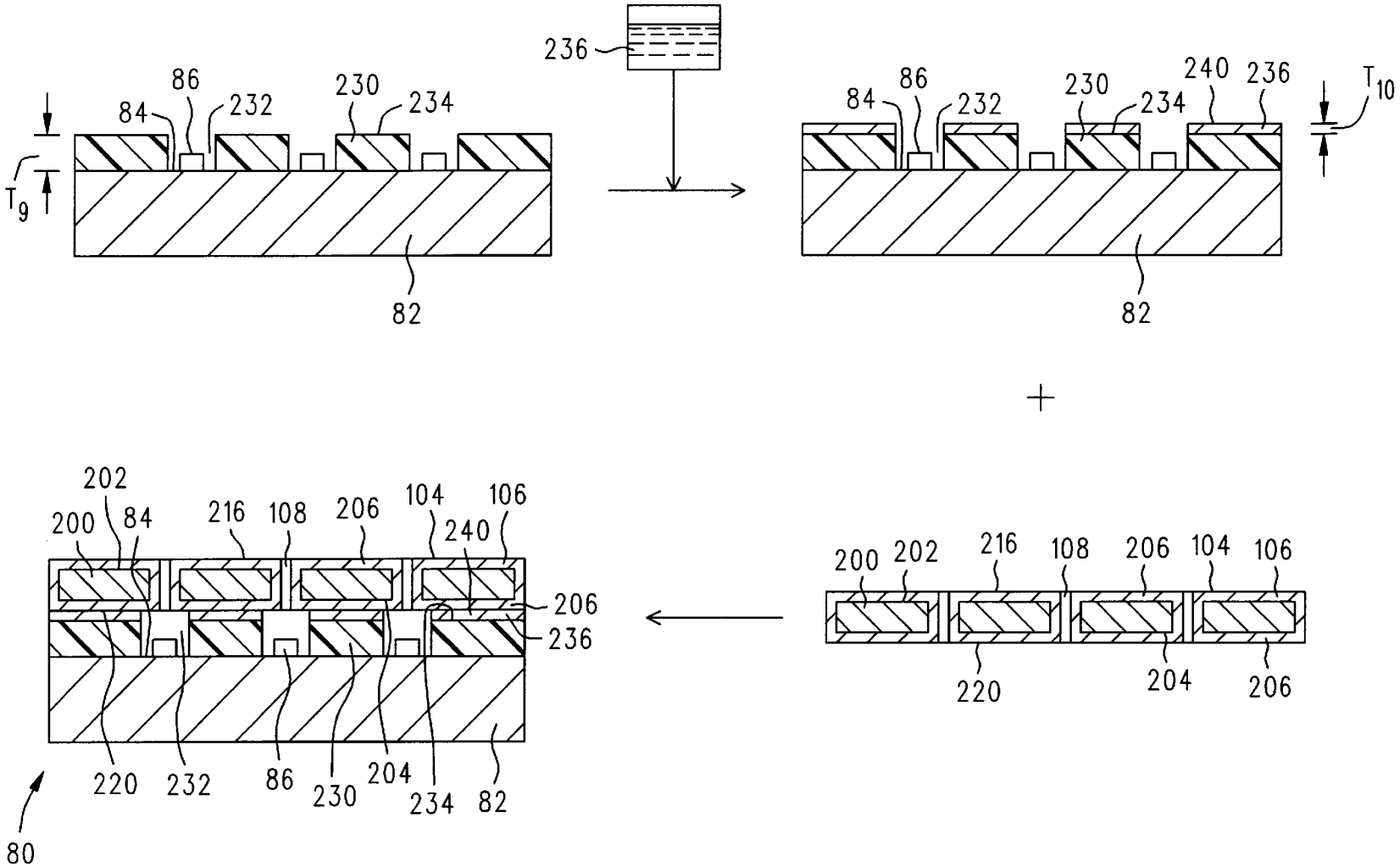
FIG. 6 is a schematic cross-sectional (e.g. partial) view in enlarged format of the completed printhead of the present invention which incorporates the orifice plate of FIG. 3, along with the production steps that are used to produce the printhead, wherein adhesive materials are employed during assembly in an alternative embodiment.

An alterative processing/assembly system suitable for manufacturing the printhead 80 is schematically illustrated in FIG. 6. Common reference numbers which appear in FIGS. 5–6 represent components, elements, and features which are the same in both embodiments. As noted above, a preferred embodiment of the invention involves an assembly system which is self-adhesive and does not require the use of separate adhesive materials between the orifice plate 104 and the barrier layer 230. This self-adhesive capability is directly accomplished in accordance with the unique chemical characteristics of the rhodium employed in the bottom surface 220 of the orifice plate 104. While self-adhesion will effectively occur in connection with the organic materials listed above which are used to produce the barrier layer 230 (as well as other compounds known in the art for this purpose), an optional adhesive composition may nonetheless be employed between the orifice plate 104 and barrier layer 230. This additional adhesive may be desired in special printhead applications (e.g. systems which involve high temperatures, physically adverse operating conditions, and/or the use of highly corrosive ink materials). While the use of adhesive compositions to secure the rhodium-containing orifice plate 104 to the underlying barrier layer 230 is not required in a preferred embodiment, a decision to use separate adhesive compounds to supplement/augment the unique capabilities of rhodium may be determined in accordance with preliminary pilot testing involving the factors listed above. Even if additional adhesives are employed between the rhodium-containing bottom surface 220 of the orifice plate 104 and the barrier layer 230, the use of rhodium in the bottom surface 220 of the orifice plate 104 will provide substantially superior adhesion (in cooperation with the selected adhesives) compared with non-rhodium-containing orifice plates used with the same adhesive materials. Thus, regardless of whether separate adhesives are employed, the presence of rhodium in the bottom surface 220 of the orifice plate 104 in order to create a rhodium-containing "bonding surface" provides a unique degree of adhesion which constitutes a substantial departure from prior systems.

With continued reference to FIG. 6, the process steps associated with this embodiment are illustrated. All of these steps are substantially the same as those listed above in connection with the system of FIG. 5 except for the use of a separate adhesive composition to adhere the orifice plate 104 to the barrier layer 230. As illustrated in FIG. 6, a portion or supply of at least one adhesive composition/material 236 is provided which is used to accomplish the attachment process. The adhesive composition 236 is applied to (1) the upper face 234 of the barrier layer 230; (2) the rhodium-containing bottom surface 220 of the orifice plate 104; or (3) to both the upper face 234 of the barrier layer 230 and the bottom surface 220 of the orifice plate 104. Accordingly, to achieve effective results, the adhesive composition 236 shall be delivered to at least one of the upper face 234 of the barrier layer 230 and the bottom surface 220 of the orifice plate 104 as noted above. In the example of FIG. 6, the adhesive composition 236 is applied to the upper face 234 of the barrier layer 230. However, all of the information presented herein regarding application of the adhesive composition 236 to the upper face 234 of the barrier layer 230 is equally applicable to delivery of the adhesive composition 236 to the rhodium-containing bottom surface 220 of the orifice plate 104.

Many different methods may be employed to apply/deliver the adhesive composition 236 to the barrier layer 230 and/or orifice plate 104, with the present invention not being restricted to any given application processes. Representative and non-limiting application methods include but are not limited to vapor deposition, dip coating, spin coating, and the like. It should also be noted that the bottom surface 220 of the orifice plate 104 and/or the upper face 234 of the barrier layer 230 are preferably cleaned in a thorough, complete, and conventional manner prior to delivery of the adhesive composition 236 thereto.

As a result of the foregoing process and in accordance with the representative and non-limiting embodiment of FIG. 6, the adhesive composition 236 (after delivery) forms a discrete adhesive layer 240 on the upper face 234 of the barrier layer 230 which ultimately resides between the upper face 234 of the barrier layer 230 and the bottom surface 220 of the orifice plate 104 after final assembly of the printhead 80 as discussed in greater detail below. In a representative and non-limiting embodiment, the adhesive layer 240 will have a thickness "$T_{10}$" (FIG. 6) of about 5–1000 angstroms, with this value being subject to change as needed in accordance with preliminary routine testing. To apply the adhesive composition 236/layer 240 at the desired and appropriate thickness level "$T_{10}$" as noted above, it is preferred in a representative embodiment that about $2\times10^{-7}$–$5\times10^{-5}$ g of the selected adhesive composition 236 be applied per $cm^2$ of the upper face 234 of the barrier layer 230 or the bottom surface 220 of the orifice plate 104 (depending on which component is selected for initial adhesive delivery), although this value may likewise be varied as necessary. Likewise, the numerical $g/cm^2$ range listed above may be suitably adjusted if the adhesive composition 236 is applied to both the barrier layer 230 and orifice plate 104 so that the adhesive composition 236 is evenly distributed between both of the foregoing components. Finally, in the present embodiment, the adhesive composition 236 shall optimally be applied in such a manner as to avoid blocking the orifices 108/vaporization chambers 232.

Many different materials may be used in connection with the adhesive composition 236, with the present invention not being restricted to any particular chemical compounds for this purpose. The superior adhesion characteristics of rhodium (alone or combined with other metals) in connection with the bottom surface 220 of the orifice plate 104 are equally applicable to a wide variety of different adhesive compositions. For example, the claimed product and process are prospectively applicable to adhesive compounds ranging from uncured poly-isoprene photoresist which is applied using standard photolithographic and other known methods as discussed in U.S. Pat. No. 5,278,584 (incorporated by reference) to known epoxy and acrylate-based adhesive materials. However, in a representative and preferred embodiment, it has been discovered that optimum results are achieved in connection with the rhodium materials in the bottom surface 220 of the orifice plate 104 if the adhesive composition 236 involves (1) polyacrylic acid; or (2) a selected silane coupling agent. Especially efficient results are achieved when the adhesive composition 236 consists of polyacrylic acid or a selected silane coupling agent because of the unique bonding interactions which occur between (A) the rhodium-containing bottom surface 220 of the orifice plate 104; (B) the polyacrylic acid or silane adhesive composition 236; and (C) the barrier layer 230. The term "polyacrylic acid" shall be defined to involve a compound having the following basic polymeric chemical structure: $[CH_2CH(COOH)]_n$ wherein n=25–10,000. Polyacrylic acid is commercially available from a number of different sources including but not limited to Dow Chemical Corporation of Midland, Mich. (USA). Likewise, the term "silane coupling agent" as used herein shall be defined to encompass compositions which basically include one or more functional groups combined with silicon to produce an adhesive material. This term shall encompass a wide variety of compounds (including silanes and thiosilanes), without restriction to any particular compositions and materials. Representative examples of silane coupling agents which may be employed in the present invention include but are not limited to the following compounds:

1. $RSi(OH)_3$
2. $RSi[O(CH_2)_xCH_3)]_3$[wherein x=0–20]
3. $RSi(SH)_3$

In all of the structural formulas listed above, the following R groups are applicable:

| | | |
|---|---|---|
| (A) | $(CH_2)_nCH_3$ | [wherein n = 0–20] |
| (B) | $(CH_2)_nNH_2$ | [wherein n = 0–20] |
| (C) | $(CH_2)_nCO_2H$ | [wherein n = 0–20] |
| (D) | $(CH_2)_nCN$ | [wherein n = 0–20] |
| (E) | $(CH_2)_nOH$ | [wherein n = 0–20] |
| (F) | $(CH_2)_nCONH_2$ | [wherein n = 0–20] |
| (G) | $(CH_2)_nO(CH_2)_nCH_3$ | [wherein n = 0–20] |
| (H) | $(CH_2)_nCO(CH_2)_nCH_3$ | [wherein n = 0–20] |
| (I) | $(CH_2)_nCO_2(CH_2)_nCH_3$ | [wherein n = 0–20] |
| (J) | $(CH_2)_nX$ | [wherein n = 0–20 and X = Cl, F, Br, I] |

These and other silane coupling agents are commercially available from numerous suppliers including but not limited to Dow Chemical Corporation of Midland, Mich. (USA) [product nos. 6011, 6020, 6030, and 6040], as well as OSi Specialties of Danbury, Conn. (USA) [product no. "Silquest" A-1100]. All of the information listed above regarding thickness levels $T_{10}$ associated with the adhesive layer 240, the amount of adhesive composition 236 applied to the barrier layer 230 and/or orifice plate 104, and representative application methods is equally applicable to each of the adhesive compositions listed above. Likewise, the foregoing adhesive compositions 236 are optimally applied to the upper face 234 of the barrier layer 230 and/or the rhodium-containing bottom surface 220 of the orifice plate 104 in liquid form, with an exemplary liquid adhesive solution consisting of the selected adhesive composition 236 in a $10^{-4}$ to $10^{-1}$ molar concentration within a solvent including but not limited to water, hexane, cyclohexane, methanol, and ethanol. However, the present invention shall not be restricted to any particular solutions or compounds in connection with the adhesive composition 236 which shall be selected in accordance with preliminary pilot studies taking into consideration the particular barrier layers 230 and printhead designs of interest.

The final step in the printhead assembly process shown in FIG. 6 involves attaching the orifice plate 104 to the barrier layer 230 with the adhesive composition 236/layer 240 therebetween. This is accomplished in the embodiment of FIG. 6 by placing the bottom surface 220 of the orifice plate 104 against and in direct physical contact with the adhesive layer 240 on the upper face 234 of the barrier layer 230. Specifically, the bottom surface 220 of the orifice plate 104 is urged toward and against the adhesive layer 240 on the upper face 234 of the barrier layer 230 which will adhere the barrier layer 230 to the orifice plate 104. The claimed process and product as discussed herein shall not be restricted to any particular assembly order in which the orifice plate 104 is attached to the barrier layer 230. The attachment process may take place as outlined above or instead may involve placement of the barrier layer 230 against the orifice plate 104 (with the adhesive layer 240 therebetween) if desired in accordance with the production equipment and processing facilities under consideration. In this regard, any assembly method(s) may be employed provided that, in some manner, the orifice plate 104 and barrier layer 230 are attached together with the adhesive composition 236/layer 240 therebetween. As a result of this assembly procedure and the use of a rhodium-containing bottom surface 220 associated with the orifice plate 104, both of these components are secured together in a highly effective manner which avoids premature orifice plate 104 detachment/disengagement and controls problems associated with internal corrosion (oxidation) caused by chemical interactions between the orifice plate 104 and ink compositions 32 being delivered by the printhead 80. The unique chemical interactions which take place between the rhodium in the bottom surface 220 of the orifice plate 104, the adhesive composition 236, and the barrier layer 230 are the same as those listed above relative to the embodiment of FIG. 5. This is especially true in connection with the bonding reaction between rhodium and the adhesive composition 236 which will be substantially similar (from a chemical standpoint) to the reaction between rhodium and the barrier layer 230 as previously described. While the foregoing alternative process shall not be limited to any particular temperature and pressure conditions, it is preferred that during physical engagement between the orifice plate 104 and the barrier layer 230 (with the adhesive layer 240 therebetween), all of these components be subjected (e.g. heated) to a temperature of about 160–350° C., with pressure levels of about 75–250 psi being exerted on such components. A conventional heated pressure-exerting platen apparatus may again be employed for this purpose. The exact temperature and pressure levels to be selected in a given situation may be determined in accordance with routine preliminary testing taking into consideration the particular materials being used in connection with the barrier layer 230 and adhesive composition 236.

Notwithstanding the information provided above, a number of variations to the basic assembly procedure of FIG. 6 are possible in further alternative embodiments of the invention. In addition to using the other orifice plate types shown in FIGS. 2 and 4, application of the adhesive composition 236 may involve the delivery of more than one adhesive layer 240 (not shown) to the upper face 234 of the barrier layer 230, the rhodium-containing bottom surface 220 of the orifice plate 104, or to both of these components. However, regardless of which method is employed to secure the orifice plate 104 to the barrier layer 230 (including the methods of FIGS. 5–6 ), the presence of rhodium in the bottom surface 220 of the plate 104 provides greatly improved adhesion as discussed above. The use of a rhodium-containing top surface 216 in connection with the orifice plate 104 (which is preferred but not required) provides the additional benefits of (1) greater abrasion/scratch resistance; (2) improved corrosion (oxidation) resistance relative to the exterior regions of the printhead 80; and (3) a more aesthetic, mirror-like outward visual appearance. Likewise, in a preferred (non-limiting) embodiment of the process shown in FIG. 6 which uses an adhesive composition 236, the rhodium-containing bottom surface 220 of the orifice plate 104 shall be considered "directly affixed" to the barrier layer 230, with this term involving a situation wherein no intervening metal layers or other layers of material (aside from the adhesive layer 240) are present between these components.

The completed printheads 80 (minus the flexible circuit member 118) are shown cross-sectionally in FIGS. 5–6. With reference to FIG. 5, the finished printhead 80 specifically contains the following elements: (1) the substrate 82 having an upper surface 84, with the upper surface 84 including at least one ink ejector thereon (e.g. a resistor 86 if a thermal inkjet system is involved); (2) a barrier layer 230 positioned on at least a portion of the upper surface 84 of the substrate 82; and (3) the orifice plate 104 having at least one orifice 108 therethrough and a bottom surface 220 comprised of rhodium as defined above, with the bottom surface 220 being directly attached (e.g. self-adhered) to the upper face 234 of the barrier layer 230. The same components, materials, and structural relationships are present in the printhead 80 of FIG. 6, except that the printhead 80 shown in FIG. 6 includes a layer 240 of at least one adhesive composition 236 (optimally comprised of polyacrylic acid or a selected silane coupling agent) which is positioned between the rhodium-containing bottom surface 220 of the orifice plate 104 and the upper face 234 of the barrier layer 230 in order to attach (e.g. directly affix) these components together and provide enhanced adhesion. In the embodiments of FIGS. 5–6, the top surface 216 of the orifice plate 104 is likewise comprised of rhodium as defined above, although other embodiments (see FIG. 2) may not necessarily include a rhodium-containing top surface 216. The completed representative (non-limiting) printheads 80 illustrated in FIGS. 5–6 are durable, shock resistant, and avoid problems associated with corrosion/oxidation. Regarding the corrosion resistance of the claimed printheads 80, they can be used with a wide variety of different ink compositions 32 (FIG. 1) including but not limited to those listed in U.S. Pat. No. 4,963,189 to Hindagolla (which involves black ink products), as well as colored ink materials of the type described in U.S. Pat. No. 5,198,023 to Stoffel. However, it is important to emphasize that the present invention (e.g. the selected printhead 80 and cartridge 10) shall not be restricted to the delivery of any particular ink compositions. Likewise, the printhead 80 of the invention is suitable for use with a number of ink cartridge systems including those in which the printhead 80 is directly affixed to the cartridge housing (e.g. housing 12 shown in FIG. 1) or operatively connected via one or more tubular ink transfer conduits to a remotely-positioned ink storage vessel (not shown). Use of the printhead 80 in connection with the cartridge 10 of FIG. 1 may be achieved as discussed above or in any other manner wherein the printhead 80 (e.g. any of the embodiments illustrated in FIGS. 2–4) is secured to the cartridge 10 so that the printhead 80 is in fluid communication with the ink retaining compartment 30 in the housing 12. This may be accomplished by the application of conventional adhesive materials (e.g. epoxy resin compounds known in the art for this purpose) to (1) the housing 12; and (2) one or more of the substrate 82, flexible circuit member 118, and orifice plate 104 as needed in accordance with the particular cartridge 10 under consideration.

The present invention represents an advance in the art of printhead construction by providing a printhead system in which the orifice plate 104 and barrier layer 230 are securely affixed together in a manner that is permanent and substantially improved compared with prior attachment systems. The claimed invention (which specifically involves the use of rhodium in at least the bottom surface 220 of the orifice plate 104) also provides a number of important general benefits compared with previous printhead designs. These benefits include but are not limited to: (A) a greater degree of strength, durability, and shock resistance; (B) improved printhead longevity; (C) more uniform print quality and reliability over the life of the printhead; (D) enhanced corrosion resistance; (E) a desirable mirror-like aesthetic appearance when rhodium is present in the top surface 216 of the orifice plate 104; and (F) an improved level of overall structural integrity.

Having herein set forth preferred embodiments of the invention, it is anticipated that suitable modifications may be made thereto by individuals skilled in the relevant art which nonetheless remain within the scope of the invention. For example, the invention shall not be limited to any particular cartridge unit types, ink ejectors, and operational parameters within the general guidelines set forth above. Likewise, unless otherwise indicated herein, the invention shall not be restricted to any particular dimensions and construction materials. The present invention shall therefore only be construed in accordance with the following claims:

The invention that is claimed is:

1. A method for producing a high-durability printhead for use in an ink cartridge comprising:

providing a substrate comprising an upper surface, said upper surface comprising at least one ink ejector thereon for expelling ink on-demand from said printhead and a layer of barrier material positioned on at least a portion of said upper surface of said substrate;

providing an orifice plate member comprising at least one opening passing therethrough and a bottom surface comprised of rhodium; and securing said bottom surface of said orifice plate member and said layer of barrier material together in order to produce said printhead.

2. The method of claim 1 wherein said orifice plate member further comprises a top surface, said top surface also being comprised of rhodium.

3. The method of claim 1 wherein said ink ejector comprises at least one resistor.

4. The method of claim 1 wherein said securing of said bottom surface of said orifice plate member and said layer of barrier material together comprises:

applying an adhesive composition to at least one of said bottom surface of said orifice plate member and said layer of barrier material on said substrate; and attaching said bottom surface of said orifice plate member and said layer of barrier material together using said adhesive composition, said adhesive composition being positioned between said bottom surface of said orifice plate member and said layer of barrier material after said attaching thereof together.

5. The method of claim 4 wherein said adhesive composition is selected from the group consisting of polyacrylic acid and at least one silane coupling agent.

6. A method for producing a high-durability printhead for use in an ink cartridge comprising:

providing a substrate comprising an upper surface, said upper surface comprising at least one ink ejector thereon for expelling ink on-demand from said printhead and a layer of barrier material positioned on at least a portion of said upper surface of said substrate;

providing an orifice plate member comprising an internal support member, said internal support member comprising at least one opening passing therethrough and a lower face thereon, said orifice plate member further comprising a metallic coating layer positioned on said lower face of said internal support member, said metallic coating layer being comprised of rhodium; and securing said layer of barrier material and said metallic coating layer on said orifice plate member together in order to attach said orifice plate member to said layer of barrier material and thereby produce said printhead.

7. The method of claim 6 wherein said internal support member further comprises an upper face, said metallic coating layer comprised of rhodium also being positioned on said upper face of said support member.

8. A high-durability printhead for use in an ink cartridge comprising:

a substrate comprising an upper surface and at least one ink ejector on said upper surface for expelling ink on-demand from said printhead;

a layer of barrier material positioned on at least a portion of said upper surface of said substrate; and an orifice plate member comprising at least one opening passing therethrough and a bottom surface comprised of rhodium, said bottom surface of said orifice plate member and said layer of barrier material being fixedly secured together in order to form said printhead.

9. The printhead of claim 8 wherein said orifice plate member further comprises a top surface, said top surface also being comprised of rhodium.

10. The printhead of claim 8 wherein said printhead further comprises a portion of adhesive material positioned between and secured to said bottom surface of said orifice plate member and said layer of barrier material, said adhesive material attaching said bottom surface of said orifice plate member and said layer of barrier material together.

11. The printhead of claim 10 wherein said adhesive material is selected from the group consisting of polyacrylic acid and at least one silane coupling agent.

12. A high-durability printhead for use in an ink cartridge comprising:

a substrate comprising an upper surface and at least one ink ejector on said upper surface for expelling ink on-demand from said printhead;

a layer of barrier material positioned on at least a portion of said upper surface of said substrate; and an orifice plate member comprising an internal support member, said internal support member comprising at least one opening passing therethrough and a lower face thereon, said orifice plate member further comprising a metallic coating layer positioned on said lower face of said internal support member, said metallic coating layer being comprised of rhodium, said metallic coating layer on said orifice plate member and said layer of barrier material being fixedly secured together in order to form said printhead.

13. The printhead of claim 12 wherein said internal support member further comprises an upper face, said metallic coating layer comprised of rhodium also being positioned on said upper face of said support member.

14. An ink cartridge comprising:

a housing comprising a compartment therein; and a high-durability printhead in fluid communication with said compartment, said printhead comprising:

a substrate comprising an upper surface and at least one ink ejector on said upper surface for expelling ink on-demand from said printhead;

a layer of barrier material positioned on at least a portion of said upper surface of said substrate; and an orifice plate member comprising at least one opening passing therethrough and a bottom surface comprised of rhodium, said bottom surface of said orifice plate member and said layer of barrier material being fixedly secured together in order to form said printhead.

15. The ink cartridge of claim 14 wherein said orifice plate member further comprises a top surface, said top surface also being comprised of rhodium.

16. The ink cartridge of claim 14 wherein said printhead further comprises a portion of adhesive material positioned between and secured to said bottom surface of said orifice plate member and said layer of barrier material, said adhesive material attaching said bottom surface of said orifice plate member and said layer of barrier material together.

17. The ink cartridge of claim 16 wherein said adhesive material is selected from the group consisting of polyacrylic acid and at least one silane coupling agent.

18. An ink cartridge comprising:

a housing comprising a compartment therein; and a high-durability printhead in fluid communication with said compartment, said printhead comprising:

a substrate comprising an upper surface and at least one ink ejector on said upper surface for expelling ink on-demand from said printhead;

a layer of barrier material positioned on at least a portion of said upper surface of said substrate; and an orifice plate member comprising an internal support member, said internal support member comprising at least one opening passing therethrough and a lower face thereon, said orifice plate member further comprising a metallic coating layer positioned on said lower face of said internal support member, said metallic coating layer being comprised of rhodium, said metallic coating layer on said orifice plate member and said layer of barrier material being fixedly secured together in order to form said printhead.

19. The ink cartridge of claim 18 wherein said internal support member further comprises an upper face, said metallic coating layer comprised of rhodium also being positioned on said upper face of said support member.

* * * * *

UNITED STATES PATENT AND TRADEMARK OFFICE

CERTIFICATE OF CORRECTION

PATENT NO. : 6,155,676
DATED : December 5, 2000
INVENTOR(S) : H. Thomas Etheridge III et al.

It is certified that error appears in the above-identified patent and that said Letters Patent is hereby corrected as shown below:

Title page,
Item [57], ABSTRACT,
Line 10, "optionally be" should read -- optionally --.

Signed and Sealed this

Thirty-first Day of December, 2002

JAMES E. ROGAN
*Director of the United States Patent and Trademark Office*